US011187114B2

(12) United States Patent
Dupont

(10) Patent No.: US 11,187,114 B2
(45) Date of Patent: Nov. 30, 2021

(54) MECHANICAL SYSTEM FOR GENERATING MECHANICAL ENERGY FROM LIQUID NITROGEN, AND CORRESPONDING METHOD

(71) Applicant: Eric Dupont, Montévrain (FR)

(72) Inventor: Eric Dupont, Montévrain (FR)

( * ) Notice: Subject to any disclaimer, the term of this patent is extended or adjusted under 35 U.S.C. 154(b) by 0 days.

(21) Appl. No.: 16/332,208

(22) PCT Filed: Aug. 30, 2017

(86) PCT No.: PCT/FR2017/000158
§ 371 (c)(1),
(2) Date: Mar. 11, 2019

(87) PCT Pub. No.: WO2018/046807
PCT Pub. Date: Mar. 15, 2018

(65) Prior Publication Data

US 2019/0218944 A1 Jul. 18, 2019

(30) Foreign Application Priority Data

Sep. 9, 2016 (FR) ..... 16/01329

(51) Int. Cl.
*F01K 25/10* (2006.01)
*F17C 9/04* (2006.01)
(Continued)

(52) U.S. Cl.
CPC ..... *F01K 25/10* (2013.01); *F01K 13/00* (2013.01); *F17C 7/04* (2013.01); *F17C 9/04* (2013.01);
(Continued)

(58) Field of Classification Search
CPC ..... F01K 13/00; F01K 25/04; F01K 25/10; F01K 27/00; F17C 7/04; F17C 9/04;
(Continued)

(56) References Cited

U.S. PATENT DOCUMENTS 3,724,229 A 4/1973 Seliber
3,950,957 A 4/1976 Zakon
(Continued)

FOREIGN PATENT DOCUMENTS

AU 2008229566 A1 9/2008
CA 2666325 C 4/2008
(Continued)

OTHER PUBLICATIONS

Wang et al. A Novel Pumped Hydro Combined with Compressed Air Energy Storage System. Energies 2013, 6, 1554-1567. ISSN 1996-1073.*
(Continued)

*Primary Examiner* — Mark A Laurenzi
*Assistant Examiner* — Mickey H France
(74) *Attorney, Agent, or Firm* — Mark M. Friedman

(57) ABSTRACT

The invention relates to a system for generating mechanical energy, comprising at least: a compressor; an expander; a heat exchanger; said system having a motor operative mode in which said system additionally comprises: means for the intake of pressurised liquid nitrogen in a liquid nitrogen intake inlet of said exchanger, means for the intake of air or gaseous nitrogen in an air or gaseous nitrogen intake inlet of said exchanger, means for discharging vaporised nitrogen at a vaporised nitrogen outlet of said exchanger, and means for discharging air or cooled nitrogen at another outlet of said exchanger for air or cooled gaseous nitrogen; means for the intake of said vaporised nitrogen into the interior of said expander in order to expand same; means for the intake of the air or cooled gaseous nitrogen into said compressor so as to produce compressed air or gaseous nitrogen therein.

11 Claims, 9 Drawing Sheets

(51) Int. Cl.
*F01K 13/00* (2006.01)
*F17C 7/04* (2006.01)

(52) U.S. Cl.
CPC ..... *F17C 2221/014* (2013.01); *F17C 2223/0153* (2013.01); *F17C 2227/0157* (2013.01); *F17C 2227/0306* (2013.01); *F17C 2265/038* (2013.01); *F17C 2270/0168* (2013.01)

(58) Field of Classification Search
CPC ..... F17C 2221/014; F17C 2223/0153; F17C 2227/0157; F17C 2227/0306; F17C 2265/038; F17C 2270/0168; F02C 1/08; F02C 1/10
USPC ..... 60/645, 649, 650, 651, 670, 671, 673, 60/682–684
See application file for complete search history.

(56) References Cited

U.S. PATENT DOCUMENTS

| | | | | |
|---|---|---|---|---|
| 3,998,059 | A * | 12/1976 | Randell | F01K 3/10 60/659 |
| 4,197,715 | A | 4/1980 | Fawcett | |
| 4,341,072 | A | 7/1982 | Clyne | |
| 4,429,536 | A | 2/1984 | Nozawa | |
| 4,449,379 | A | 5/1984 | Dibrell | |
| 5,924,305 | A | 7/1999 | Hill | |
| RE37,603 | E | 3/2002 | Coney | |
| 8,234,862 | B2 | 8/2012 | Magari | |
| 8,984,857 | B2 | 3/2015 | Minta | |
| 9,399,950 | B2 | 7/2016 | Mittricker | |
| 2007/0280400 | A1 | 12/2007 | Keller | |
| 2009/0158739 | A1 | 6/2009 | Messmer | |
| 2011/0067410 | A1 | 3/2011 | Zubrin | |
| 2011/0203311 | A1 | 8/2011 | Wright | |
| 2015/0000280 | A1* | 1/2015 | Harris | F02C 1/08 60/651 |

FOREIGN PATENT DOCUMENTS

| | | | | |
|---|---|---|---|---|
| CA | 2774632 | C | 3/2011 | |
| CN | 2240320 | C | 8/1997 | |
| CN | 1659372 | B | 8/2005 | |
| FR | 3032224 | A1 | 8/2016 | |
| GB | 2300673 | A | 7/1996 | |
| JP | 05149676 | A * | 6/1993 | F25J 3/04387 |

OTHER PUBLICATIONS

Choudhury. Process Design of Turboexpander Based Nitrogen Liquefier. 2009. Thesis Submitted in Partial Fulfillment of the Requirements for the Degree of Master of Technology in Mechanical Engineering. National Institute of Technology Rourkela.*

Khalil et al. Liquid Air/Nitrogen Energy Storage and Power Generation System for Micro-Grid Applications. Journal of Cleaner Production, vol. 164, Oct. 15, 2017, 606-617.*

* cited by examiner

Decreased operation of the liquid nitrogen generator

MECHANICAL SYSTEM FOR GENERATING MECHANICAL ENERGY FROM LIQUID NITROGEN, AND CORRESPONDING METHOD

1. FIELD OF THE INVENTION

The invention relates to a system for generating mechanical energy from liquid nitrogen and/or the production of liquid nitrogen or other liquefied gas.

With variants, the invention concerns a system for storing energy in the form of liquid nitrogen or other liquefied gases such as air.

2. PRIOR ART

The international patent application bearing number WO-A1-2014/154715 describes a reversible mechanical system that can function in two modes, namely:

- one mode for producing liquid nitrogen during operation, wherein the liquid nitrogen is produced and stored, and
- a motor mode during operation, wherein the previously produced and stored liquid nitrogen is consumed to generate mechanical energy which could be used to drive an alternator and produce electric current or to power a vehicle, for example.

In generator mode, the system consists of a piston compressor which takes in gaseous nitrogen that can be compressed. The compressed nitrogen is introduced into an exchanger where it is cooled before entering a piston expander where it is expanded and partially liquefied. The liquid nitrogen thus produced is stored. The non-liquefied nitrogen within the expander enters the heat exchanger to cool the compressed gaseous nitrogen originating from the compressor to be returned to the compressor.

In motor mode, the liquid nitrogen, pumped under high pressure, is vaporised in an exchanger before entering an initial piston expander (which acts as the expander where liquid nitrogen is formed in generator mode), then a second piston expander (which acts as the low-pressure compressor in generator mode). The pistons are connected to a single crankshaft which is rotated by the expansion of the vaporised nitrogen within the expanders.

Operating said generator and motor modes allows energy to be stored in great quantities by producing liquid nitrogen in a simple and efficient manner and by restoring the mechanical energy from the said liquid nitrogen to drive an alternator and produce an electric current or to power a vehicle, for example . . . .

However, it is still possible to further improve the performance of the generator mode in order to produce a greater quantity of liquid nitrogen with each expansion and the performance of the motor mode in order to generate a greater quantity of mechanical energy with each expansion.

3. PURPOSE OF THE INVENTION

The particular purpose of the invention is to provide an efficient solution for at least some of these various problems.

In particular, using at least one performance mode, one purpose of the invention is to increase the performance in motor mode of a mechanical system for producing mechanical energy from liquid nitrogen or other liquefied gas.

Another purpose of the invention is, using at least one performance mode, to increase the performance in generator mode of a mechanical system for producing liquid nitrogen or other liquefied gas.

In particular, the purpose of the invention, using at least one performance mode, is to provide such a system that is simple and/or efficient and/or robust and/or cost-effective.

Another purpose of the invention, in at least one performance mode, is to increase the overall performance and to reduce the cost of the energy storage system both in terms of storage and in terms of restoring energy by combining the three previously cited purposes.

4. PRESENTATION OF THE INVENTION

For this, the invention provides a system of generating mechanical energy comprising at least:

- a compressor;
- an expander;
- a heat exchanger;

said system having a motor operative mode in which said system additionally comprises:

- means for the intake of pressurised liquid nitrogen in a liquid nitrogen intake inlet of said exchanger, means for the intake of air or gaseous nitrogen in an air or gaseous nitrogen intake inlet of said exchanger, means for discharging vaporised nitrogen at a vaporised nitrogen outlet of said exchanger, and means for discharging air or cooled nitrogen at another outlet of said exchanger for air or cooled gaseous nitrogen;
- means for the intake of said vaporised nitrogen into the interior of said expander in order to expand same;
- means for the intake of the air or cooled gaseous nitrogen into said compressor so as to produce compressed air or gaseous nitrogen therein;
- means for expanding said compressed air or gaseous nitrogen;
- means for heating the compressed air or gaseous nitrogen prior to intake into said expansion means or the interior of said expansion means;
- means for recovering energy originating from the expansion of said vaporised nitrogen and the expansion of said compressed air or gaseous nitrogen.

In terms of the invention, the term gaseous or liquid nitrogen essentially means composed of nitrogen but may also refer to a low proportion of other elements and a weaker proportion of oxygen but sufficient for combustion, if desired. The proportion of nitrogen in the treated fluid will ideally be between 90 and 98%.

However, it is possible to use the invention with air. In this case, the invention may be used as a simple and economical liquefier of air and for usage other than the storage of energy.

Thus, using this aspect of the invention, the cooling of air or gaseous nitrogen in the exchanger followed by a compression, preferably adiabatic, then an expansion of same, with a supply of thermic energy before and/or during the expansion, with a substantially greater volume, for example four times greater, generates an excess of mechanical energy.

This allows the mechanical energy resulting from the change of phase and the heating of the liquid nitrogen to be recovered and, thus, to increase the performance in motor mode in comparison to a simple expansion of liquid nitrogen after pressurisation and vaporisation.

5. LIST OF FIGURES

Other features and benefits of the invention will become apparent upon reading the following description of specific performance modes, given by way of simple illustrative and non-limited examples, and the attached drawings, among which:

Figure 8:
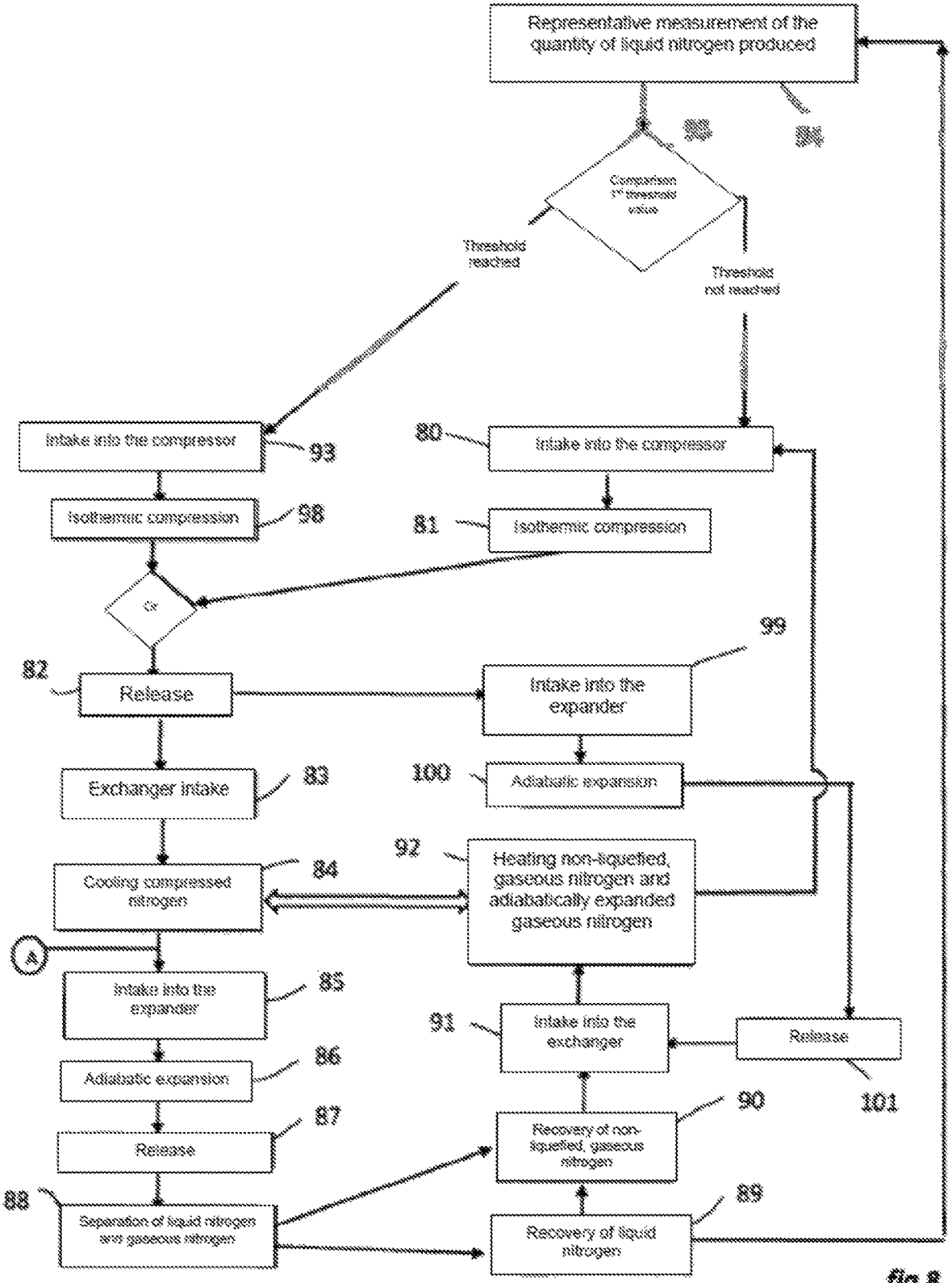
Figure 8B:
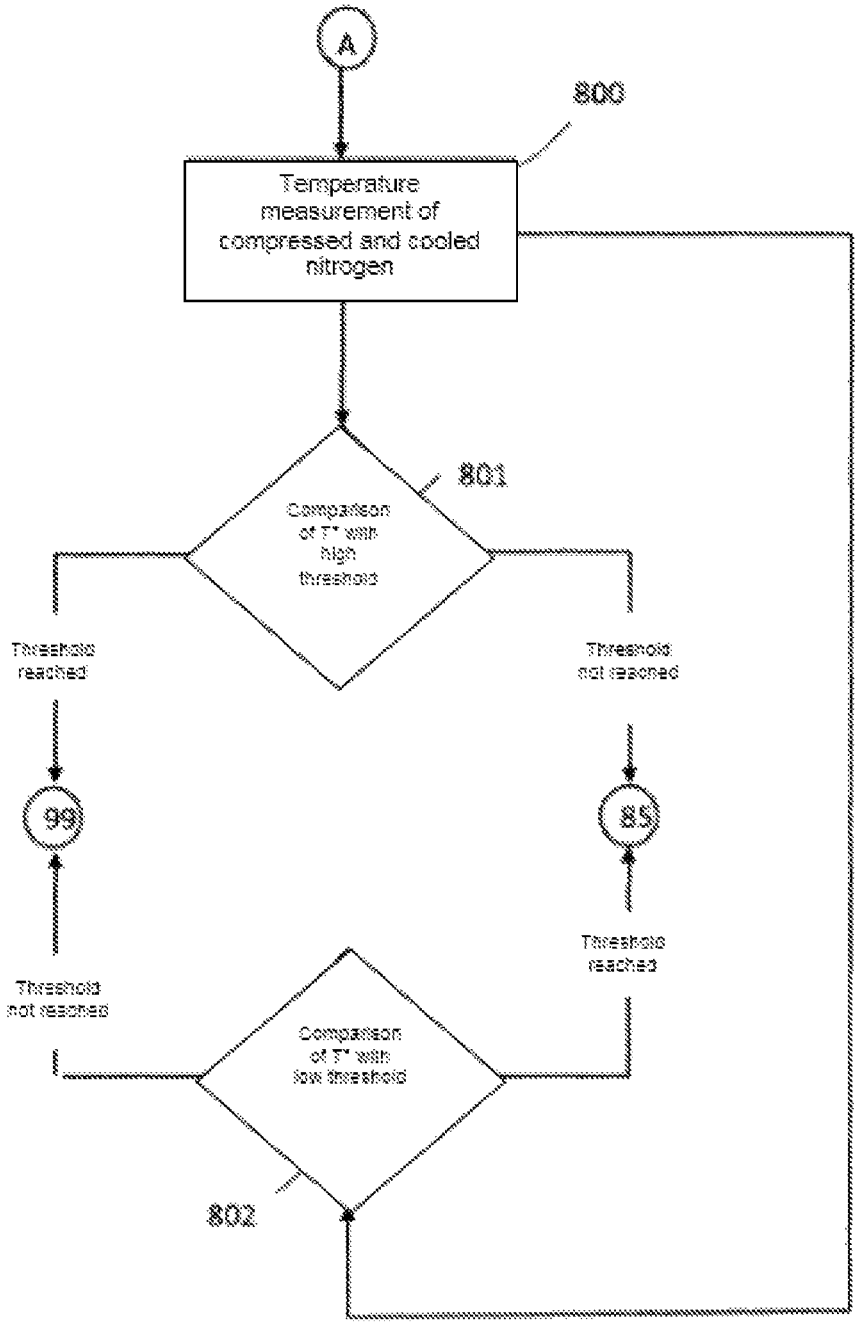
Figure 9:
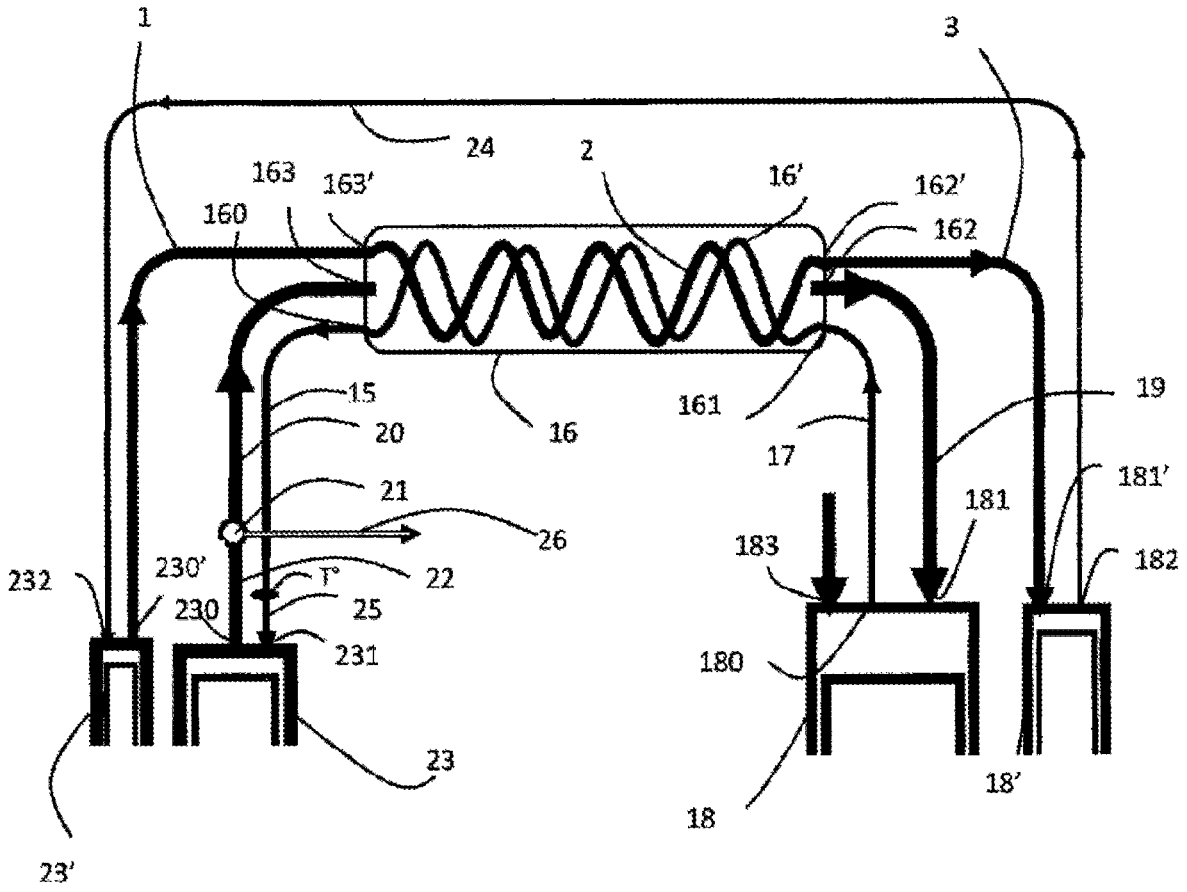
Figure 10:
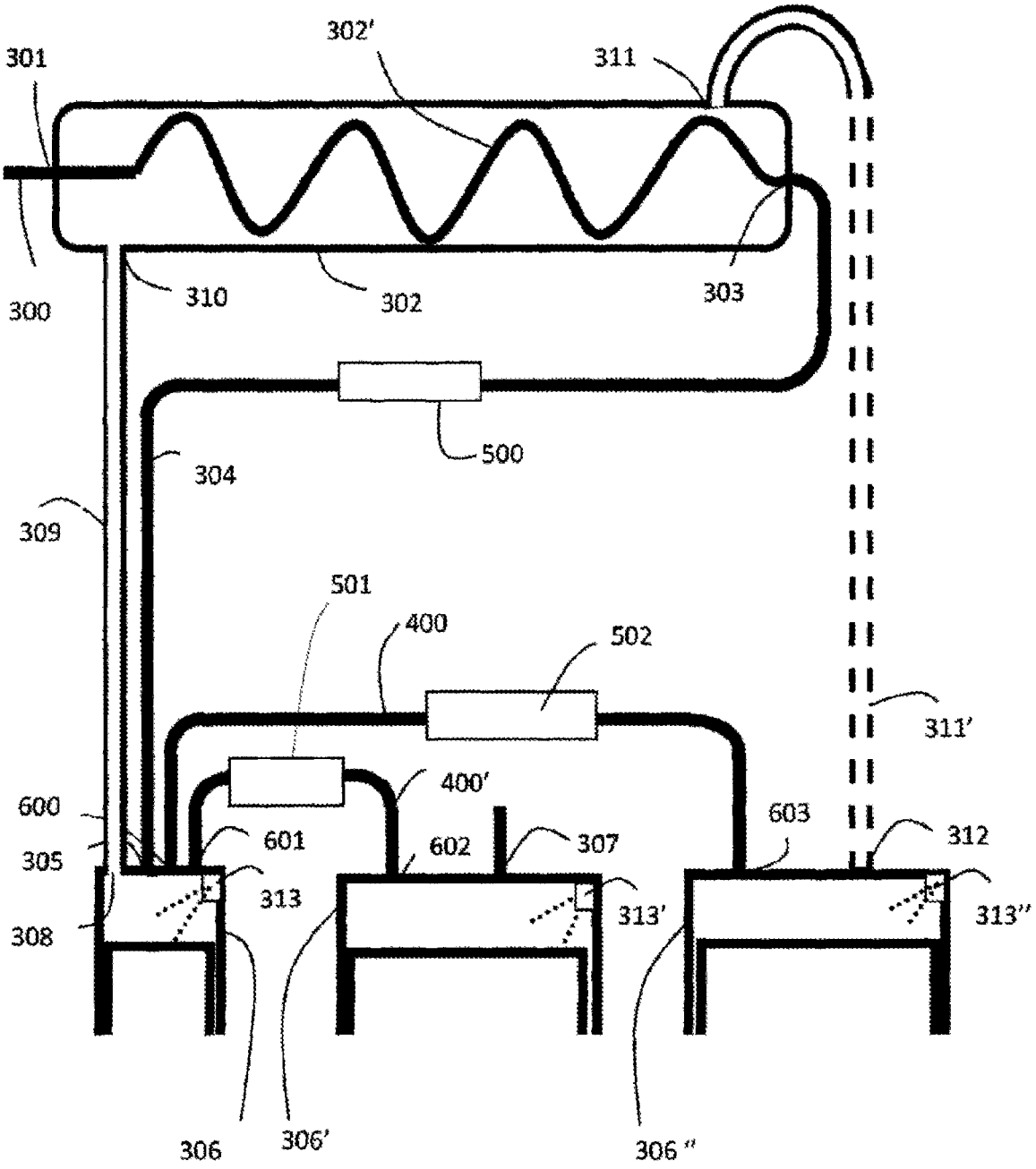

FIGS. 8 and 8*b* illustrate the stabilised operation phase of a liquid nitrogen production procedure using the invention;

FIG. 9 illustrates a variant of a system using the developed variant of the invention comprising several compressors or expanders;

FIG. 10 illustrates a variant of a system using the simplified variant of the invention comprising a staged compressor/expander with two low pressure expansion chambers.

6. DESCRIPTION OF SPECIFIC PERFORMANCE MODES

6.1. Generation of Mechanical Energy

6.1.1. Mechanical System for Generating Mechanical Energy from Liquid Nitrogen The invention concerns a mechanical system for generating mechanical energy from liquid nitrogen.

i. Simplified Version

Figure 1:
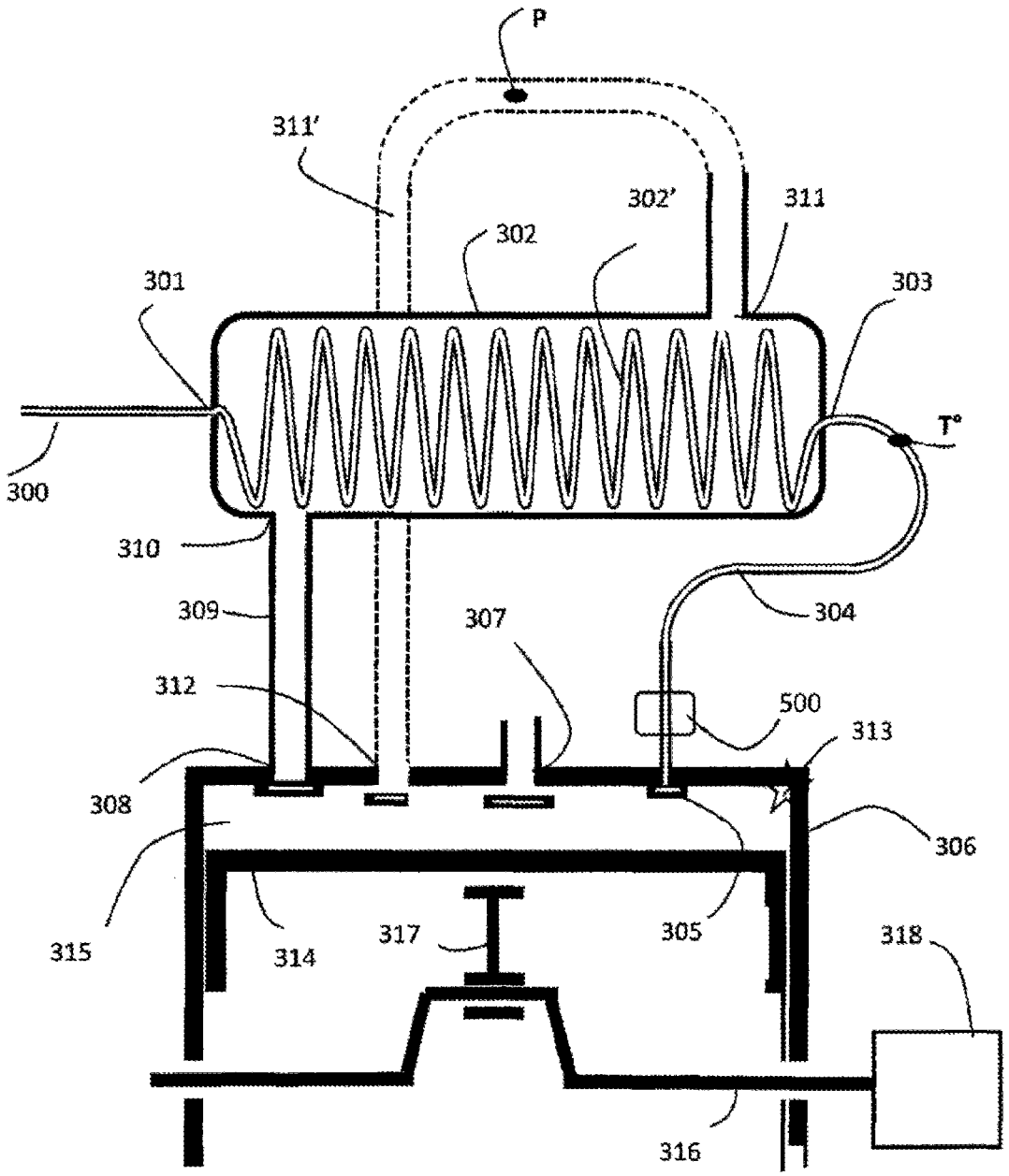
FIG. 1 illustrates a diagram of a system for generating mechanical energy from liquid nitrogen using a simplified variant of the invention.

In reference to FIG. 1, such a system is presented in its simplified version.

Such a system comprises a pipe 300 of liquid nitrogen under pressure which leads to a liquid nitrogen inlet 301 of a heat exchanger 302.

The heat exchanger 302 comprises a vaporised and heated nitrogen outlet 303 which is connected by pipe 304 to a heated vaporised liquid nitrogen inlet 305 of a compressor/expander 306. The heat exchanger 302 comprises an ambient air inlet 311.

The exchanger 302 is crossed by pipe 302' which runs from inlet 301 in the exchanger to outlet 302 in the exchanger. Pipe 302' acts as the thermic exchange surface within the exchanger with the fluid that crosses it internally, the liquid nitrogen and the fluid that goes over it externally, the air or nitrogen. It can be comprised of a set of stacked plates forming conduits or even be comprised of multiple pipes connected to the inlet 301 and the outlet 303 of the exchanger.

The compressor/expander 306 comprises a discharge outlet 307 for expanded air or gaseous nitrogen. It comprises a cool air inlet 308 which is connected by a pipe 309 to a cool air outlet 310 from the exchanger 302.

The compressor/expander 306 may, for example, be a system comprising at least one piston 314 that moves within a chamber 315 and is connected to a crankshaft 316 by a connecting rod 317. This crankshaft may, for example, be connected to an alternator 318 to produce an electric current, serve to power a vehicle or similar.

Rather than be connected to a crank connecting arm-type system, the piston in the compressor/expander may be connected to a linear electric engine or alternator.

The system comprises means of heating vaporised nitrogen prior to its entering the expander 306 or heating within the expander 306. They may comprise a heater 500 located on the pipe 304. Alternatively, or additionally, they may comprise means of injecting fluid 313 into the expander to ensure heating.

In one variant (represented in dashes on FIGS. 1 and 10), the inlet 311 may be connected directly to another outlet for nitrogen under pressure (residual pressure from the expansion) 312 of the compressor/expander 306 via a pipe 311'. As will become clearer subsequently in relation to the description of the functioning of the system, this allows the size of the system to be reduced (in particular the exchanger 302 and the compressor/expander 306).

Figure 4:
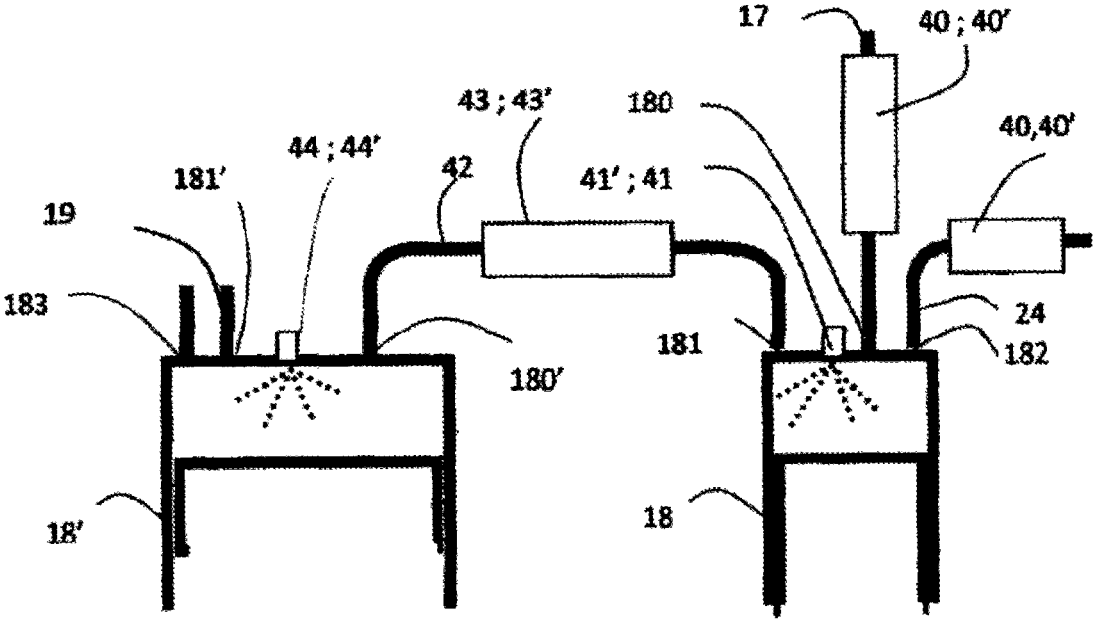

In one variant, which may be combined with the previous variant, the compressor/expander 306 (FIG. 1) may be staged to compress or expand multiple times at different pressures, using the principle set out in FIG. 4. Multiple expanders/compressor (two or more) may thus be used with means for the fluid from one expander/compressor to enter another compressor/expander with the aim of expanding or compressing at a different pressure than in the previous one.

For two stages of compressor/expander, the high-pressure compressor/expander also comprises an additional aperture with the pipe that connects an additional aperture in the low-pressure expander, inlet apertures 308 and 305, the low pressure compressor/expander will comprise outlet apertures 312 and 307 (each of apertures 308, 305, 312 and 307 being connected to their respective pipe according to FIG. 1).

In another variant according to FIG. 10 and in relation to the previous variant where the compressor/expander was staged, the second low pressure stage may comprise two expanders 306' and 306", each connected to the high-pressure stage by pipes 400 and 400', themselves connected to apertures 600, 601, 602 and 603. One of the low-pressure expanders may comprise an outlet for fresh air via aperture 307, and the other low pressure expander, an outlet by aperture 312, which may be connected to the exchanger inlet 311 by pipe 311', as indicated in a previous variant.

In this variant, the means of heating the vaporised nitrogen prior to it entering an expander or heating within an expander may be positioned within each expander/compressor and, alternatively or additionally, on the inlet pipe for each of them. Thus, on FIG. 10, the external heaters 500, 501 and 502 are located on pipes 304, 400 and 400', the internal heaters 313, 313' and 313" are located within the compressor/expander 306, 306' and 306".

These means of heating may be provided by, for example, the direct injection of energy-carrying fluid, such as petrol, with combustion, or by a fluid possessing significant mass heat, such as water. In the variants wherein, heat is sourced from outside the expander, it may be obtained via a heat exchanger heated by a heat-conveying fluid, itself heated by a source of heat: solar concentration or combustion of gas or petrol.

This heating increases the volume of the gas to be expanded and reduces the consumption of liquid nitrogen for the same quantity of mechanical energy generated.

A pressure gauge P is optionally placed on pipe 311' and a temperature gauge T° is optionally placed on pipe 304.

ii. Developed Version

Figure 2:
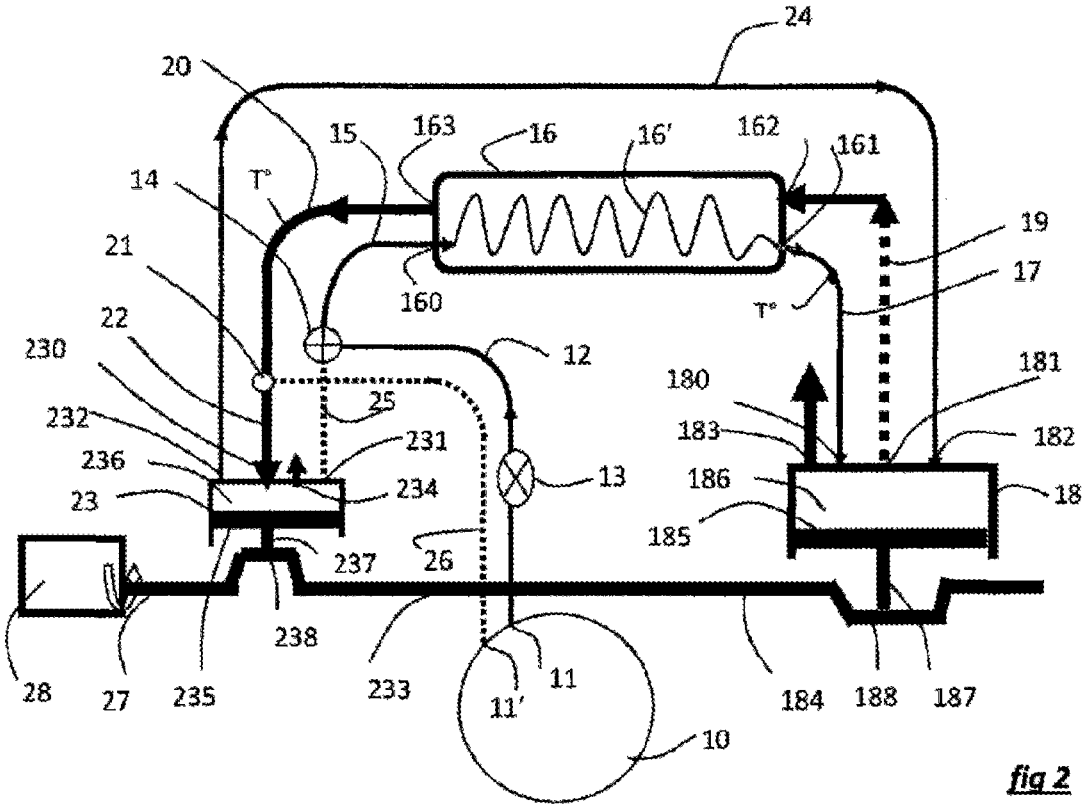
FIG. 2 illustrates a diagram of a system for generating mechanical energy from liquid nitrogen using a developed variant of the invention.

In reference to FIG. 2, such a system is presented in its more developed version.

Such a system comprises a reservoir of liquid nitrogen 10.

This reservoir 10 comprises an outlet for liquid nitrogen 11 which is connected to a pipe 12 between two sections of which is positioned a pump 13. The pump 13 may be positioned within the reservoir 10. It is optional as the pressure may be obtained by heating the reservoir, for example.

The pipe 12 leads to a valve 14.

The valve 14 comprises an outlet that is connected by a pipe 15 to the liquid nitrogen inlet 160 of a heat exchanger 16.

The valve 14 is optional and pipes 12 and 15 may constitute a single pipe when the valve 14 is not used.

The heat exchanger 16 comprises an outlet 161 for heated vaporised nitrogen.

The exchanger 16 is crossed by the pipe 16' which runs from inlet 160 of the exchanger to outlet 161 of the exchanger. The pipe 16' acts as the thermic exchange surface within the exchanger with the fluid which crosses it internally, the liquid nitrogen and the fluid which goes over it externally, the air or the nitrogen. It can be comprised of a set of stacked plates forming conduits or even be comprised of multiple pipes connected to the inlet 160 and the outlet 161 of the exchanger.

The heated vaporised nitrogen outlet 161 is connected to a pipe 17 which leads to the vaporised nitrogen inlet 180 of an expander 18 and optionally has a temperature gauge T°.

The heat exchanger 16 comprises an air inlet 162, preferably at ambient temperature or lower. This inlet 162 may optionally and alternatively be connected by a pipe 19 to an optional outlet for gaseous nitrogen under pressure (residual pressure from the expansion) 181 from the expander 18.

The heat exchanger 16 comprises an outlet 163 for cooled air or nitrogen. This outlet is connected to pipe 20 which leads to a valve 21.

The pipe 20 optionally features a temperature gauge T.

The valve 21 is connected by a pipe 22 to an inlet for cool air or nitrogen 230 for an adiabatic compressor 23.

The valve 21 is optional and pipes 20 and 22 may constitute a single pipe when the valve 21 is not used.

The adiabatic compressor 23 comprises an outlet 232 for compressed air or nitrogen.

The outlet for compressed air or nitrogen 232 is connected by a pipe 24 to an inlet for compressed air or nitrogen 182 for the expander 18.

The expander 18 comprises a discharge outlet for gaseous nitrogen 183.

The valve 14 is optionally connected to an optional pipe 25 which is connected to an optional aperture 231 of the adiabatic compressor 23. The valve 21 is optionally connected to an optional pipe 26, connected to an optional aperture 11', of the optional liquid nitrogen reservoir 10. These optional elements are not necessary for the generation of mechanical energy. As will be described later, they are necessary for the production of liquid nitrogen.

The expander 18 and the adiabatic compressor 23 each comprise a drive shaft 184 and 233.

The system comprises an output shaft 27. This may, for example, be connected to an alternator 28 to produce an electric current, serve to power a vehicle or similar.

The drive shaft 184 of the expander 18 constitutes or is connected to the output shaft 27 from the system, either directly or via transmission.

Ideally, the drive shaft 184 of the expander 18 is connected to that of the adiabatic compressor 23, directly or via transmission, such that the adiabatic compressor 23 is moved by the expander 18. Otherwise, auxiliary motor means must be used to drive the drive shaft of the compressor 23.

The drive shaft 233 of the compressor 23, the drive shaft 184 of the expander 18 and the output shaft 27 of the system may constitute one single shaft, as represented in FIG. 2. In this case, the expander drives both the adiabatic compressor and the output shaft.

The expander 18 and the adiabatic compressor 23 each comprise one or several pistons 185 and 235 that move in translation in one or several chambers 186 and 236 and are connected via connecting rods 187 and 237 to a crankshaft 188 and 238. The expander crankshaft constitutes the expander drive shaft and the compressor crankshaft constitutes the compressor drive shaft.

Ideally, the compressor and the expander share the same crankshaft that constitutes or is connected to the system output shaft.

Alternatively, the expander and the compressor may each consist of a turbine comprising a stator housing a rotor comprising, respectively, the expander drive shaft and the compressor drive shaft. The compressor rotor shaft, the expander rotor shaft and the output shaft may constitute a single shaft.

Rather than be connected to a connecting rod crank-type system, the compressor and/or expander pistons may be connected to a linear electric motor or alternator.

The compressor and the expander may be allowed to perform staged expansions and/or compressions. In this case, the compressor and the expander will be staged to compress or expand multiple times at different pressures, using the principle set out in FIG. 4. Several expanders/compressors (two or more) may thus be used with means for the fluid from one expander/compressor to enter another compressor/expander with the aim of expanding or compressing at a different pressure than in the previous one.

Within the expander 18 and the compressor 23 are successively produced a multitude of cycles which will be described in more detail below in relation to the description of the procedure for the generation of mechanical energy.

The system using the invention clearly comprises means of control to manage the opening and closing of the various apertures (inlets, outlets) of the expander and the compressor in order to synchronise these cycles and their various phases (intake, expansion, compression, release). Such means are known in their own right and are not described in detail.

The system comprises means of heating the vaporised nitrogen and/or the compressed air or gaseous nitrogen prior to entering the expander or of heating within the expander.

Figure 3:
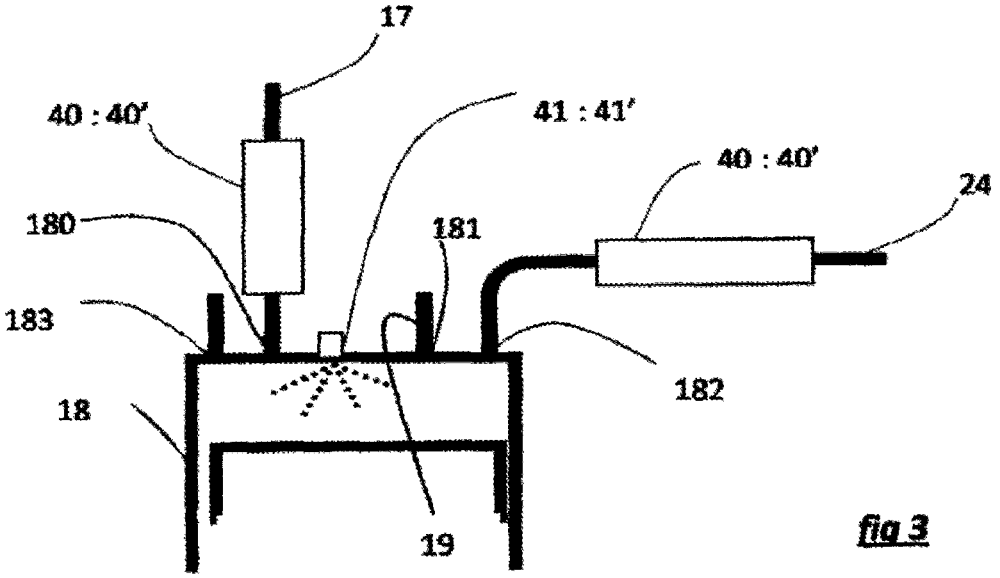
FIGS. 3 and 4 illustrate means of heating or cooling upstream and in an expander or a compressor that is respectively simple or staged.

In reference to FIG. 3, such means of heating comprise an external heating system 40, positioned on pipes 17 and/or 24. Alternatively or additionally, they can comprise an internal heating system 41, allowing the injection of fluid into the expander, providing the heat.

In the various variants, the means of heating increase the temperature of the gas by, for example, the direct injection of a hot fluid, such as water, without combustion or of a fluid with combustion, such as petrol. In the variants wherein, heat is sourced from outside the expander, it may be obtained via a heat exchanger heated by a heat-conveying fluid, itself heated by a source of heat: solar concentration or combustion of gas or petrol. It may also refer to a heating system within the walls of the expander. This applies as part of the simplified version.

FIG. 4 illustrates a variant according to which the expander is staged, which is to say that it comprises multiple expanders 18 and 18', positioned in series, the partially expanded vaporised nitrogen outlet 181 from one (18) is connected to the partially expanded vaporised nitrogen inlet 180' into the other (18') by a pipe 42. The inlets/outlets 181' (optionally connected to the aperture 162 in the exchanger 16 by the pipe 19) and 183 are located within the low-pressure expander 18' and the inlets/outlets 180 and 182 are located within the high pressure expander 18.

In this case, the heating means comprise an external heating system 40 located on pipes 17 and/or 24. Alternatively or additionally, they can comprise an internal heating system 41 allowing the injection of fluid into the expander (hot fluid, such as water, without combustion, within the expander or fluid with combustion within the expander) which provides the heat. They can also comprise an external heating system 43 located on the pipe or pipes 42 and/or an internal heating system 44 (of the system 41 type) located in the expander or expanders 18'. It may also refer to a heating system within the walls of the expander or expanders.

A system such as that described in relation to FIG. 4 may also allow a staged compressor to be achieved by placing multiple compressors 18' and 18 in series. In this case, the internal and/or external means of heating are means of cooling.

In one variant, wherein the pressure within the pipes 17 and 24 is approximately equal, these two pipes may be connected and feed into the same inlet 180 or 182.

In another variant, wherein the pressures within the pipes 17 and 24 are different, two expanders may be used, one fed by pipe 17 and the other fed by pipe 24.

In another variant, the expansion of the air or of the cooled nitrogen may take place following compression within compressor 23 which will then serve as the expander after the compression phase.

The mechanical energy resulting from the expansion within the compressor 23 will then be recovered via its drive shaft. The compressor 23, which will then be a compressor/expander, will comprise an additional aperture 234 for the release of the compressed air or cold nitrogen within it and means of heating within the expander/compressor and/or on the pipe 24.

The reservoir, the pipes and the valve which are connected to it are optional. What is important is that the system comprises a liquid nitrogen inlet that is intended to be connected to a pressurised liquid nitrogen supply device.

6.1.2. Procedure for the Generation of Mechanical Energy

Figure 6:
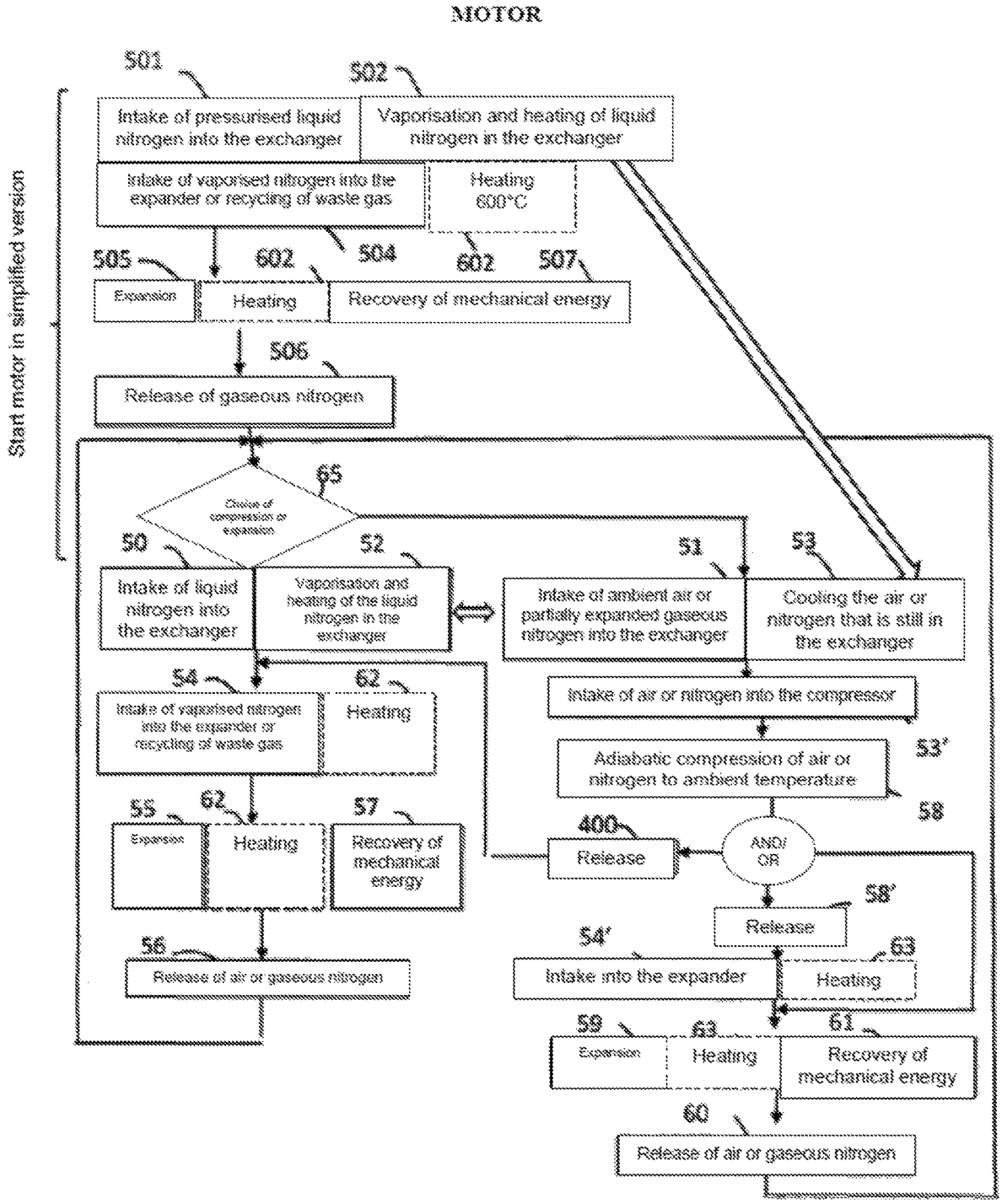
FIG. 6 illustrates a diagram of a system for generating mechanical energy using the invention

A procedure for the generation of mechanical energy from liquid nitrogen will now be described in relation to FIG. 6.

i. Simplified Version

The procedure described in this paragraph corresponds to the operation of the simplified version of the system described in relation to FIG. 1 in a variant wherein the expander-compressor comprises a piston-sleeve assembly, where the piston is connected to a crankshaft.

When the system is started, it is necessary to fill the pipe 302' of the exchanger and the pipe 304, which is connected to the expander, with pressurised (for example, 300 bar) gaseous (i.e. vaporised) nitrogen, prior to sending the pressurised liquid nitrogen into the pipes, this is in order to avoid the vaporisation of too great a quantity of liquid nitrogen as a result of the pipes possibly being at ambient temperature and which will have the effect of increasing the pressure within the circuit more than is necessary.

For this, it is possible to plan, for example, to implement a step for the intake of liquid nitrogen into the pipe 302' (and which constitutes a buffer reserve with the pipe 304), by the opening of aperture 301 in order to introduce a small quantity of liquid nitrogen into the pipe 302' which, once vaporised and heated will establish the desired pressure level.

The quantity of liquid nitrogen to be introduced into pipes 302' and 304 for this phase of the start-up is related to the volume of same and the desired pressure (around 200/300 bar).

The start-up phase is followed by a motor launch phase then by a stabilised operating phase during which the pressure in the pipes 302' and 304 is regulated so as to maintain it at a level of pressure determined by adjusting the quantity of liquid nitrogen entering the aperture 301 of the exchanger and in relation to the quantity of air or gaseous nitrogen that enters the exchanger.

When the pipes 304 and 302' are pressurised by gaseous nitrogen, the motor launch phase is implemented.

Initially, the piston is positioned at top dead centre, the aperture 305 is open, the apertures 308, 307 and, if applicable, 312 are closed. The apertures 301 and 303 are also open throughout the launch phase and the stabilised operating phase.

Pressurised (approximately 200/300 bar) liquid nitrogen enters (step 501) at around −195° C. via the pipe 300 into the inlet 301 of the exchanger 302 then the pipe 302'.

The liquid nitrogen at around −195° C. is heated within the exchanger 302 by the air circulating within the exchanger and is then vaporised and heated until it reaches a temperature close to the ambient temperature (step 502). The purpose of this is to cool the ambient air in the exchanger to a temperature that is close to the temperature of the liquid nitrogen which was introduced (−195° C.) (step 53). Around 1.7 kg of ambient air is required to bring 1 kg of liquid nitrogen to ambient temperature.

A step 504 of admitting vaporised nitrogen that is heated to a temperature close to the ambient temperature into the exchanger 306 is implemented.

To do this, the vaporised nitrogen that is heated to ambient temperature leaves the heat exchanger 302 via the vaporised nitrogen outlet 303, is fed to the expander 306 via the pipe 304 and the open aperture 305.

Of course, steps 501 to 504 are simultaneous.

The vaporised nitrogen introduced into the expander 306 undergoes an expansion step 505, causing the descent of the piston to its bottom dead centre and setting in motion the crankshaft: this motion constitutes a step 507 for the recovery of mechanical energy.

A step 602 for heating the nitrogen will be implemented prior to intake (approximately 300/600° C.) and/or during expansion (approximately 20 to 140° C. if fluid without combustion is injected) in such a way as to have, from preference, an outlet temperature equal to or greater than the ambient temperature. For this, the heating means 500 and/or 313 will be implemented. If the heating takes place prior to intake, the expansion will preferably be adiabatic, if the heating takes place during expansion, the expansion will preferably be isothermic.

Inlet 305 closes and outlet 307 opens to allow the release of the expanded nitrogen from the expander 306 (step 506) as the piston returns to top dead centre.

The release outlet 307 closes, the motor launch phase ends whilst the stabilised operating phase starts.

The stabilised operating phase begins with a choice of operating in expansion mode or operating in compression mode.

To vaporise the liquid nitrogen adequately within the exchanger, a quantity of air must be introduced. Otherwise, the temperature of the vaporised nitrogen leaving the exchanger will not be high enough.

To ensure that the temperature of the vaporised nitrogen is sufficient, a step 65 for choosing an expansion mode or a compression mode is implemented.

Using one variant, this selection step 65 consists of measuring the temperature of the nitrogen within the pipe 300 at the outlet 303 of the exchanger or the pipe 304.

When the recorded temperature reaches a predetermined threshold signalling that a sufficient temperature has been reached, the procedure continues by initiating the expansion mode.

When the recorded temperature does not reach this predetermined threshold, that is to say that the nitrogen is insufficiently heated, the procedure continues by initiating the compression mode.

The expansion mode comprises a step 50 wherein pressurised (approximately 200/300 bar) liquid nitrogen enters at around −195° C. via the pipe 300 into the inlet 301 of the exchanger 302 then the pipe 302'.

The liquid nitrogen at approximately −195° C. is heated within the exchanger 302 by the air circulating within the exchanger and is then vaporised and heated until it reaches a temperature close to the ambient temperature (step 52). The purpose of this is to cool the ambient air in the exchanger to a temperature that is close to the temperature of the liquid nitrogen which was introduced (−195° C.) (step 53). Approximately 1.7 kg of ambient air is required to bring 1 kg of liquid nitrogen to ambient temperature.

A step 54 of admitting vaporised nitrogen that is heated to a temperature close to the ambient temperature into the exchanger 306 is implemented.

For this, the vaporised nitrogen that is heated to ambient temperature leaves the heat exchanger 302 via the vaporised nitrogen outlet 303, is fed to the expander 306 via the pipe 304 and the open aperture 305.

Of course, steps 51 to 54 are simultaneous.

The vaporised nitrogen introduced into the expander 306 undergoes an expansion step 55, causing the descent of the piston to its bottom dead centre and setting in motion the crankshaft: this motion constitutes a step 57 for the recovery of mechanical energy.

A step 62 for heating the nitrogen will be implemented prior to the intake (at approximately 300/600° C.) and/or during the expansion (approximately 20 to 140° C. if fluid without combustion is injected) in such a way as to have a temperature at outlet that is ideally equal to or greater than the ambient temperature. For this, the heating means 500 and/or 313 will be implemented. If the heating takes place prior to intake, the expansion will preferably be adiabatic, if the heating takes place during expansion, the expansion will preferably be isothermic.

Inlet 305 closes and outlet 307 opens to allow the release of the expanded nitrogen from the expander 306 (step 56) as the piston returns to top dead centre.

The outlet 307 closes again.

The compression mode comprises simultaneous implementation of the following steps:

step 51, taking ambient air into the exchanger;

step 53, cooling the air in the exchanger;

step 53', intake into the compressor.

For the implementation of steps 51, 53 and 53', the piston returns to bottom dead centre. The cooled ambient air leaving the exchanger 302 by outlet 310 undergoes step 53', intake into the compressor 306, by flowing through pipe 309 and passing through inlet 308 into the compressor.

The inlet 308 closes and the piston returns to top dead centre. The cold air (approximately −195°) then undergoes step 58, adiabatic compression (with pressure of approximately 50) whilst the piston returns to top dead centre in the compressor 302. This adiabatic compression has the effect of increasing the air temperature to the ambient temperature.

The compressed air is kept in the chamber and, under the effect of the pressure within the compressor, the piston again returns to bottom dead centre, whilst the compressed air expands (step 59). Step 63, heating the air, will be implemented during the expansion in order that it be isothermic, preferably. For this, the heating means 313 will be activated.

This expansion results in the movement of the piston and the rotation of the crankshaft and, thus, the recovery of mechanical energy (step 61). When the piston reaches bottom dead centre, aperture 307 opens, then the piston returns to top dead centre. The air which is still slightly pressurised, then leaves the compressor (step 60) into the ambient air.

The outlet 307 closes again.

At the end of the expansion mode, as at the end of the compression mode, a new step 65, choice of expansion mode or compression mode, is implemented, then a new cycle is initiated.

Using this first variant, step 65, choice between the compression mode and the expansion mode, is optimised by a temperature check on the vaporised nitrogen at the outlet from the exchanger. Using an additional or alternative variant, this step 65 may be replaced by programming the sequencing of the expansion and compression modes using the requirements of heating the liquid nitrogen and based on the quantity of air required for heating and vaporising the liquid nitrogen. It is known that, to vaporise and heat 1 kg of liquid nitrogen to the ambient temperature, 1.7 kg of air at the ambient temperature is required, therefore, approximately 1 kg of heated, vaporised liquid nitrogen at 300 bar must be introduced alternating with 1.7 kg of cooled air at 1 bar, or up to 6 bar if the air is recovered from the outlet as we will see in a later variant.

These various steps follow each other (in a short space of time) in this way to result in the movement of the crankshaft.

Several identical compression or expansion steps may follow one another, the aim being to vaporise the liquid nitrogen and heat it to a temperature that is close to the ambient temperature prior to it being heated by the heater or entering the expander and for the air that crosses the exchanger prior to being compressed to be cooled to a temperature that is close to that of the liquid nitrogen which feeds the motor.

The action of cooling the air in the exchanger and its adiabatic compression allows it subsequently to be expanded in the expander with a slightly greater volume, for example, four times greater, in order to generate an excess of mechanical energy. This allows the mechanical energy resulting from the change of phase and the heating of the liquid nitrogen to be recovered and, thus, to increase the return in terms of mechanical energy generated.

The putting into motion of the crankshaft of the expander-compressor 306 may, for example, allow an alternator to be turned to produce an electric current or to power a vehicle.

In the variant using which the inlet 311 is connected to the outlet 312 of the expander/compressor by the pipe 311', the gas that enters the exchanger to vaporise the liquid nitrogen is no longer ambient air but originates from the recovery of waste gases from the system in motor mode. In this case, the release step 56 (506) consists of releasing the expanded nitrogen, not through outlet 307, but through outlet 312, (the release through outlet 307 occurs in alternation with outlet 312 when the pressure in the pipe 311', which constitutes a buffer reservoir, has reached a determined pressure threshold, if the pressure is sufficient within the pipe 311', the release takes place into the fresh air through aperture 307, if the pressure in the pipe 311' is insufficient, the release takes place through the outlet 312 into the pipe 311'. These waste gases that are still pressurised (approximately 6 bar) are introduced into the exchanger (step 51) and serve to vaporise the liquid nitrogen during step 52. This facilitates the heat exchanges within the exchanger and to reduce its size. Furthermore, gas is further compressed with each turn of the motor during the compression step 58. The implementation of this variant requires a start-up step during which the liquid nitrogen, vaporised, heated and stored in the expander, is released into the pipe 311', through aperture 308. This step is repeated until the pressure in the pipe 311' reaches a predetermined pressure threshold, for example, between 1 and 6 bar inclusive. Then, during stabilised operation, the pressure in the pipe is maintained by adjusting the quantity of nitrogen admitted through aperture 312, when the pressure in the pipe 311' is sufficient, the release is made alternatively into fresh air through aperture 307.

The other benefit of this variant is that, if waste gases are recovered at approximately 6 bar and the pressure report of 50 is applied for the adiabatic compression of the cold nitrogen, we are left with a large quantity of nitrogen at 300 bar at ambient temperature within the compression chamber (when the piston reaches top dead centre). Therefore, this high-pressure gas can be allowed to be released through aperture 305 to be stored temporarily within pipe 304, where the vaporised liquid nitrogen is at the same 300 bar pressure and at the same temperature and subsequently continue via several expansions of gas from pipe 304 prior to another compression. The act of reintroducing the newly-compressed gas into the pipe 304 may allow the external heating step 62 to begin. Following compression step 58, inlet 305 opens so that all or some of the air or the compressed nitrogen flows into pipe 304 where it joins the pressurised vaporised nitrogen (step 400, release). If all of the air or compressed nitrogen flows into the pipe 304, the cycle continues with step 54. If only part of the air or compressed nitrogen flows into the pipe 304, the cycle continues with step 59. The compression of the cold gas from the exchanger may result in the production of too great a volume of compressed gas in the compressor. This volume is so great that it is not possible to completely expand subsequently other than to allow a lower quantity of gas to enter or to release the still-pressurised gas into the ambient air, which reduces the efficiency of the system.

In another variant wherein the compressor/expander is staged with a high pressure chamber and a low pressure chamber and which may be combined with the variant wherein inlet 311 of the exchanger is connected to outlet 312 of the expander/compressor by pipe 311', the compression of the cold air from the exchanger (step 58) may only occur within the high pressure chamber, following which some of the compressed cold air is released from the compressor to join the heated vaporised nitrogen in the pipe 304 (step 400) whilst the rest is directly expanded within the high pressure chamber prior to joining the low pressure chamber to be completely expanded (step 59).

Steps 51, 53, 53' and 58, intake and compression of cold air within the exchanger and the expander, occur as before when the liquid nitrogen in the pipe 304 is insufficiently heated.

The high-pressure compressor/expander will comprise apertures 308 and 305, the low-pressure compressor/expander will comprise apertures 312 and 307. The two compressors will each include an additional aperture connected by a pipe serving as a buffer reservoir and that can include a heater.

In another variant and according to FIG. 10, the low-pressure stage can include two expanders, one of which will be able to include a fresh air release through outlet 307 and the other a release through outlet 312 connected to the inlet to the exchanger 311 through pipe 311'. In this latter variant, the release will occur simultaneously into the fresh air and into pipe 311'. This latter variant, which has 3 cylinders, may be transformed into a liquid nitrogen producer using the general information indicated in the liquid nitrogen production section using the variant wherein the compressor may be staged. To do this, it uses the low-pressure compressor/expander 306' and the high pressure expander 306 as the staged isothermic compressor whilst the low pressure expander 313" will be used as an expander.

ii. Developed Version

The procedure described in this paragraph corresponds to the implementation of the developed version of the system described in relation to FIG. 2 in a variant wherein the expanders and compressor each comprise a sleeve-piston assembly wherein the piston is connected to a crankshaft.

When the system is started, it is necessary to fill the pipe 16' from the exchanger and the pipe 17 (connected to expander 18), with pressurised (for example, 300 bar) gaseous nitrogen prior to sending pressurised liquid nitrogen into these pipes, this is to avoid vaporising too great a quantity of liquid nitrogen, as these pipes are at ambient temperature, which may have the effect of increasing the pressure within the circuit more than is necessary.

For this, it is possible to plan, for example, to implement a step for the intake of liquid nitrogen into the pipe 16' (and which constitutes a buffer reserve with the pipe 17), by the opening of aperture 160 in order to introduce a small quantity of liquid nitrogen into pipe 16' which, once vaporised and heated, will establish the desired pressure level.

The quantity of liquid nitrogen to be introduced into pipes 16' and 17 for this phase of the start-up is related to the volume of same and the desired pressure (for example 300 bar).

The start-up phase also requires the pipe 24 to be pressurised at approximately 50 bar (300 bar if using the waste gas recovery option at 6 bar) during the first rotations and inasmuch as the volume of the pipe represents a certain volume in relation to the compressor cylinder. The start-up and thus the pressurisation of this pipe enables the compression rate required for heating cold gas from the exchanger to be reached during stabilised operation through the adiabatic compression within the compressor. For this, it is possible to plan, for example, that the cooled air from the exchanger 16 or the vaporised nitrogen stored within the expander 18 and which reaches the adiabatic compressor 23 via the pipe 22 through the aperture 230 enters compressor 23 during the descent of the piston 235 then is compressed as the piston rises to release into pipe 24 and the cycle recommences until the pressure within the pipe 24 reaches a predetermined threshold value, whilst continuing to maintain the pressure in the pipes 16' and 17.

The start-up phase is followed by a stabilised operation phase during which the pressure in the pipes 16' and 17 is regulated so as to maintain it at a level of pressure determined by adjusting the quantity of liquid nitrogen entering the aperture 160 of the exchanger and in relation to the quantity of air or gaseous nitrogen that enters the exchanger.

The pressure within the pipe 24 is also regulated, for example by a pressure measure within it and by adjusting the quantity of gas that enters through aperture 232 of the compressor and which leaves through aperture 282 of the expander.

When the pipes 16', 17 and 24 are pressurised by the gaseous nitrogen, the stabilised operation may begin.

During stabilised operation, apertures 160 and 161 are open.

The expander piston is initially located at top dead centre, the aperture 180 is open. The apertures 183, 181 and 182 are closed.

The procedure comprises a liquid nitrogen vaporisation step within the heat exchanger 16, into which passes the ambient air or the nitrogen that is approximately at ambient temperature and still pressurised from the expander 18 and which is cooled during its passage across the exchanger 16 by the pipe 16'. The gaseous nitrogen obtained during vaporisation which, given the pressure, is in a critical phase (vapour/liquid), is heated prior to being expanded.

To do this, the liquid nitrogen at approximately −195° C. is drawn into the reservoir 10 using a pump 13 in such a way that it passes through outlet 11 of the reservoir and flows into the pipes 12 and 15 until it enters the inlet 160 of the exchanger 16, then 16' (intake step 50) at a pressure of approximately 300 bar. Ambient air enters through inlet 162 into the exchanger 16 (intake step 51).

The liquid nitrogen in the pipe 16' is heated within the exchanger 16 by the air circulating within the exchanger and is thus vaporised (vaporisation step 52) and heated to a temperature close to the ambient temperature, whilst the air circulating within the exchanger is cooled (step 53) to a temperature that is close to the temperature at which the liquid nitrogen is introduced into the exchanger (approximately −195° C.).

The procedure then comprises a step 54, taking vaporised nitrogen, at a pressure of approximately 300 bar and at a temperature that, for example, is close to the ambient temperature, from the exchanger 16 into the expander 18.

To do this, the vaporised nitrogen leaves the heat exchanger 16 via the vaporised nitrogen outlet 161, is fed into the expander 18 via the pipe 17 and the vaporised nitrogen inlet 180 which opens whilst the expander piston is at top dead centre.

Of course, steps 50, 52 and 54 are simultaneous.

The vaporised nitrogen introduced into the expander 18 undergoes an expansion step 55, causing the movement of the piston to bottom dead centre and setting in motion the expander drive shaft 184, which is to say, the crankshaft. This corresponds to a mechanical energy recovery step 57.

Step 62, heating the nitrogen (between approximately 300° C. and 600° C.), will be initiated prior to intake and/or during the expansion (10° C. to 140° C. if fluid without combustion is injected). To do this, the heating means 40 and/or 41 will be activated.

Once the piston has reached bottom dead centre, the outlet 183 opens and the piston returns to top dead centre. The vaporised nitrogen then undergoes a release step 56 via the outlet 183.

In one variant wherein the outlet 181 is connected to inlet 162 of the exchanger, the outlet 181 opens in alternation with the fresh air release outlet 183, in such a way as to obtain a constant pressure (approximately 1 to 6 bar) in the network between the aperture 181 and the aperture 230 and to provide the release step 56.

In this case, the nitrogen coming from the outlet 181 from the expander is pressurised (approximately 1 to 6 bar) when it enters through the pipe 19 in the inlet 162 into the exchanger 16 during the inlet step 51, rather than the ambient air. When the pressure in pipe 19 is sufficient, the release takes place through the aperture 183 into the fresh air.

The implementation of this variant requires a start-up step during which the liquid nitrogen, vaporised, heated and stored in the expander, is released into the pipe 19 through the aperture 181 (step 56), without entering the compressor. This step is repeated until the pressure in the network between the aperture 181 and the aperture 230 reaches a predetermined pressure threshold, for example, 1 to 6 bar. During stabilised operation, the release takes place alternatively through aperture 183 or 181 in such a way as to maintain the desired pressure within the network between aperture 181 and 230.

Using this variant, during the vaporisation step 52, the liquid nitrogen is heated within the exchanger 16 by the nitrogen from the expander circulating within the exchanger, the nitrogen from the expander being cooled there during step 53.

The intake of pressurised nitrogen from the expander into the exchanger, rather than ambient air, enables the efficiency of the exchanger to be increased and, therefore, the size of the system to be reduced.

The air or the cooled nitrogen leaving the exchanger 16 by outlet 163 undergoes step 53', intake into the compressor 23, by flowing through pipes 20, 22 and passing through inlet 230 into the compressor. To do this, inlet 230 opens whilst the compressor piston moves from top dead centre to bottom dead centre and whilst the expander piston moves from bottom dead centre to top dead centre during the release step 56.

Of course, steps 51, 53 and 53' are simultaneous.

The inlet 230 closes and the piston returns to top dead centre. The air or the cooled nitrogen undergoes a compression step 58 in the compressor 23. This compression is preferably adiabatic and has the effect of heating the gas which is at a temperature close to −195° C., for example, until the temperature is close to the ambient temperature as a result of the compression. The outlet 232 opens and the compressed air or nitrogen is then released from the compressor (at a temperature that is close to the ambient temperature, for example, and which is due to the compression) then flows into the pipe 24 which serves as buffer reservoir during a release step 58'. The aperture 232 closes and the compressor piston returns to bottom dead centre whilst the aperture 182 opens in such a way as the compressed air or nitrogen undergoes step 54', entry into the expander through inlet 182. There, it undergoes a release step 59, resulting in the descent of the expander piston to bottom dead centre and movement of the expander drive shaft 184 (step 61), then the release (step 60) as the piston returns to top dead centre whilst the aperture 183 opens.

Step 62, heating the nitrogen, will be implemented prior to intake and/or during the expansion. To do this, the heating means 40 and/or 41 will be activated.

The cooling of the air or the gaseous nitrogen within the exchanger (crossed by the liquid nitrogen that comes from the pump and the reservoir and is vaporised and heated), followed by a compression, preferably adiabatic, and an expansion with a supply of thermic energy within the expander, which generates a substantially greater volume of gas, for example four times greater, produces an excess of mechanical energy.

This allows the mechanical energy resulting from the change of phase and the heating of the liquid nitrogen to be recovered and, thus, to increase the return compared to a simple expansion of pressurised and vaporised liquid nitrogen.

When the pressure in pipes 17 and 24 is approximately equal (approximately 300 bar), vaporised nitrogen and compressed air or nitrogen may enter the expander simultaneously. These pipes may in addition be connected to each other to allow intake in one single step and at one single point of entry. When the pressures within these two pipes are different, the expansion of vaporised nitrogen and the expansion of air or of compressed nitrogen will be delayed, the first expansion taking place with the high-pressure fluid circulating within them and the following with low pressure fluid circulating within them.

When the pressure within these two pipes is different, two different expanders may be activated, one to expand the vaporised nitrogen, the other to expand the air or compressed nitrogen. The two expansions can take place simultaneously.

If the pressure in the pipe 19 is 6 bar, the pressure at the outlet from the compressor with a pressure return of 50 (to obtain the necessary heat) will be 300 bar whilst the pressure of the vaporised nitrogen will be 300 bar.

The putting into motion of the crankshaft or, more generally, of the drive shaft 184 of the expander 18 as a result of the expansion of vaporised nitrogen from the exchanger and of the compressed air or nitrogen from the compressor constitutes a step in the recovery (or generation) of mechanical energy.

These various steps follow each other so as to result in the movement of the crankshaft.

The putting into motion of the drive shaft 184 of the expander 18 may, for example, allow an alternator 28 to be turned to produce an electric current or to power a vehicle. When the drive shaft from the expander and the drive shaft from the compressor are connected or constitute a single shaft, the mechanical energy generated by the expander allows the compressor to be moved. If this is not the case, the means of driving the compressor must be activated, such as an electric or other motor, for example.

In another variant wherein the compressor 23 is a compressor/expander, following compression step 58, the aperture 232 opens in such a way that all or some of the compressed air or nitrogen flows into the pipe 24, which serves as a buffer pipe.

If all of the air or compressed nitrogen flows into the pipe 24, the cycle continues with a new intake of air or compressed nitrogen from the pipe 24 into the expander 23 through the aperture 232, followed by expansion and release through aperture 234.

The compressed air or nitrogen that is present in the pipe 24 may be stored partially in the expander 23 and partially in the expander 18.

If some of the compressed air or nitrogen remains in the compressor/expander without flowing into the buffer pipe 24, the cycle comprises an expansion of this compressed air or nitrogen in the expander 23, followed by a release through aperture 234.

The benefit of expanding some of the gas in the expander 23 is that if the machine is reversible as a generator of liquid nitrogen, the compressor 23 which is thus reversible, must constitute a larger cylinder than if it is used as a compressor alone.

All of the pipes and the heat exchanger preferably constitute buffer reserves in such a way that the various fluids required for each step are available. This will allow the various steps of the procedure to be easily synchronised.

6.2. Production of Liquid Nitrogen 6.2.1. Mechanical System for the Production of Liquid Nitrogen The invention concerns a mechanical system for producing liquid nitrogen.

Components in this system, which is structurally identical to the components in the system for the generation of mechanical energy previously described in relation to FIG. 2, bear the same numbers, although their functions in one or the other system may be different.

Figure 5:
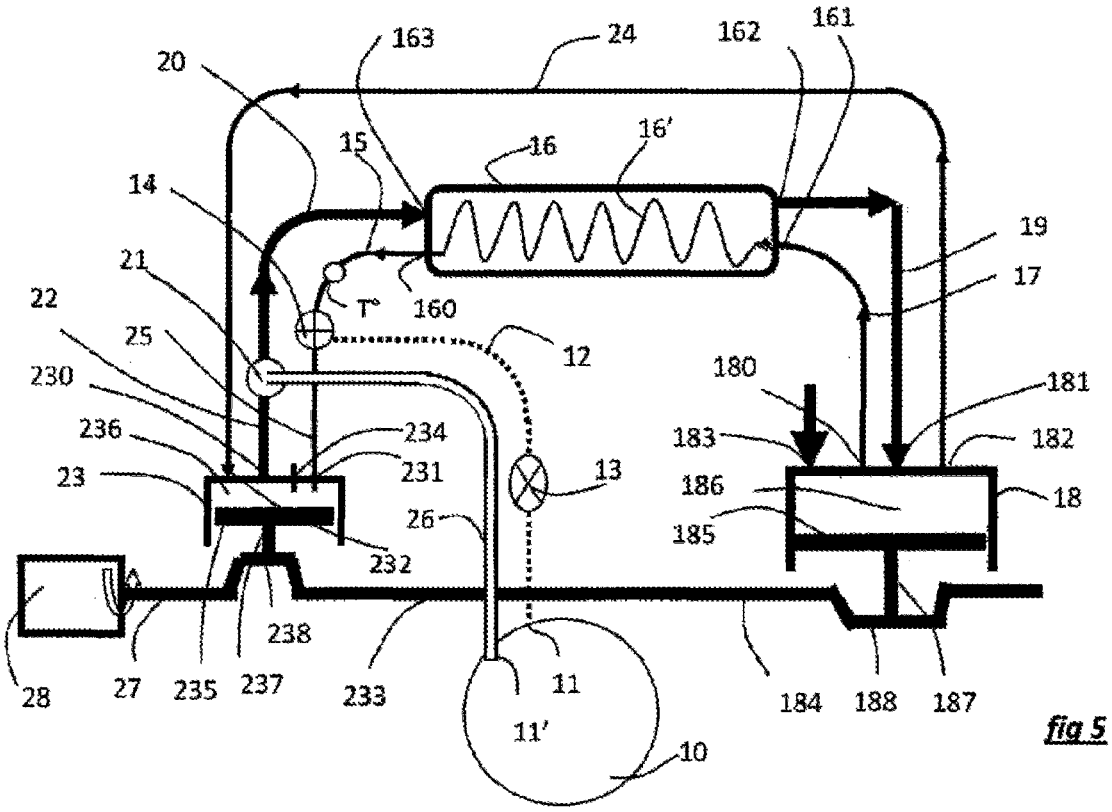
FIG. 5 illustrates a diagram of a system for producing liquid nitrogen using the developed variant of the invention.

In reference to FIG. 5, such a system comprises an isothermic compressor 18. This compressor 18 comprises:

an inlet for air or gaseous nitrogen 183;

a first outlet for compressed air or nitrogen 180;

a second outlet for compressed air or nitrogen 182;

an inlet for non-liquefied nitrogen 181.

The first outlet for air or compressed nitrogen 180 is connected by a pipe 17 to an inlet for air or compressed nitrogen 161 for a heat exchanger 16.

The heat exchanger 16 comprises an outlet for air or compressed and cooled nitrogen 160. This outlet 160 is connected to a pipe 15 which is connected to a valve 14.

The exchanger 16 is crossed by pipe 16' which runs from the inlet 161 in the exchanger to the outlet 160 from the exchanger. The pipe 16' acts as the thermic exchange surface within the exchanger for the fluid that crosses it internally, the compressed nitrogen and the fluid that goes over it externally, the cold nitrogen from the expander 23. The pipe 16' can be comprised of a set of stacked plates forming conduits or even be comprised of multiple pipes connected, therefore, to the intake 161 and the outlet 160 of the exchanger.

The valve 14 is connected by a pipe 25 to an inlet 231 for air or compressed and cooled nitrogen from an expander 23.

The valve 14 is connected to a pipe 12 on which is located a pump 13 and which is connected to a liquid nitrogen outlet 11 from the reservoir 10. The valve 14 as well as the pipe 12, the pump 13 and the outlet 11 are optional and are not required for the production of liquid nitrogen.

The expander 23 comprises an inlet 232 for air or compressed nitrogen which is connected by a pipe 24 to the second outlet for air or compressed nitrogen 182 from the compressor 18.

The expander 23 comprises an outlet 230 for a mixture of liquid nitrogen and non-liquefied nitrogen. This outlet 230 is connected to a pipe 22 which leads to a valve 21.

The valve 21 integrates the means of separation of a liquid phase and a gaseous phase.

The valve 21 comprises an outlet that is connected by a pipe 26 to the liquid nitrogen inlet 11' of the liquid nitrogen reservoir 10.

The valve 21 presents an outlet that is connected by a pipe 20 that feeds into the non-liquefied nitrogen inlet 163 of the heat exchanger 16.

The heat exchanger 16 comprises an outlet for heated non-liquefied nitrogen 162 which is connected by a pipe 19 to the non-liquefied nitrogen inlet 181 to the compressor 18.

The expander 23 and the compressor 18 each comprise a drive shaft 233 and 184.

The outlet 234 is not required.

The system comprises an output shaft 27.

The system comprises means of putting in motion the drive shafts, such as an electric or wind-powered motor 28, for example.

Ideally, the drive shaft of the expander is connected to that of the compressor in such a way that the means of driving are common to the compressor and the expander.

The drive shaft of the compressor, the drive shaft of the expander and the output shaft of the system may constitute one single shaft. The means of driving are thus connected to the output shaft and may, for example, comprise an electric or wind-powered motor 28.

The compressor and/or the expander may be staged to compress or expand multiple times at different pressures, using the principle set out in FIG. 4. Multiple expanders/compressors (two or more) may thus be operated with the means to allow the fluid from one expander/compressor to enter another compressor/expander with the aim of expanding or compressing at a different pressure than in the previous one.

The expander 18 and the compressor 23 each comprise one or several pistons 185 and 235, assembled such that they move in translation within one or several chambers 186 and 236 and are connected via the connecting rods 187 and 237 to a crankshaft 188 and 238. The expander crankshaft constitutes the expander drive shaft and the compressor crankshaft constitutes the compressor drive shaft.

Rather than be connected to a crank connecting arm-type system, the pistons in the compressor and/or the expander may be connected to a linear electric engine or alternator.

Ideally, the compressor and the expander share the same crankshaft that constitutes or is connected to the system output shaft.

Alternatively, the expander and the compressor may each consist of a turbine comprising a stator housing a rotor comprising, respectively, the expander drive shaft and the compressor drive shaft. The compressor rotor shaft, the expander rotor shaft and the output shaft may constitute a single shaft.

The system comprises means of cooling the compressed nitrogen within the compressor, either inside the compressor and/or upon release when the compressor is staged. The means of cooling allow the heat generated by the compression to be evacuated and to reduce the compression effort in such a way that the volume of the gas does not increase.

Ideally, this means of cooling is identical to the means of heating from the system in motor mode, which is thus reversible. In any case, they can be positioned in approximately the same places. In the case of staged compression, they allow cooling between each compression.

In reference to FIG. 3, such cooling means comprise an external cooling system 40' placed on the pipes 17 and/or 24. Alternatively or additionally, they can comprise an internal cooling system 41' allowing the injection of fluid into the expander (cold fluid such as water) to provide the cooling. It may also refer to a cooling system within the walls of the compressor.

In reference to FIG. 4, they comprise internal cooling means 44' and 41' and/or external cooling means 43' and 40'.

In one variant, two expanders may be put into operation. One of these expanders will comprise an inlet 231 connected to the pipe 25 and an outlet 230 connected to the pipe 22. The other will comprise an inlet 232 connected to the pipe 24 and an outlet 230' connected to the pipe 25.

In one variant, two compressors may be put into operation. One of these compressors will comprise an inlet 181 connected to the pipe 19, an outlet 180 connected to the pipe 17 and, if necessary, an inlet 183. The other will comprise an inlet 181' connected to the pipe 19, an outlet 182 connected to the pipe 24 and, if necessary, an inlet 183.

In one variant illustrated in FIG. 9, if two expanders and two compressors are put into operation, using the preceding variants, there may be two distinct return circuits.

The first circuit is composed of the original circuit with the isothermic compressor 18 and the adiabatic expander 23, the exchanger 16, the two networks of pipes between the apertures 230, 181, 231 and 180, the separator 21, with the liquid nitrogen outlet 26 and the gaseous nitrogen inlet 183. The pipe 24 is located in the second circuit.

The second circuit is composed of the second compressor 18' and thus comprises the outlet 182 connected to the pipe 24, itself connected to the second expander 23' by the inlet 232 whilst another network of pipes 1, 2 and 3 connects the outlet 230' from the expander 23' to the inlet 181' of the second isothermic compressor 18', crossing the exchanger 16 through the inlet 163' and the outlet 162'. The exchanger 16 is thus crossed by two pipes 2 and 16'.

The two circuits, composed primarily of two networks each, are independent from each other and can therefore operate at different pressures, the second circuit which is completely closed and which can carry a gas other than nitrogen provides the cooling of the exchanger 16 whilst the first circuit produces liquid nitrogen by expanding the nitrogen that has been cooled within the expander and compressed within the compressor. The cooling circuit offsets the liquid nitrogen that is produced but that does not have a part to play in cooling the compressed nitrogen within the exchanger. Regulation of the cooling circuit can be ensured by a temperature probe positioned on the pipe 25 which feeds the expander where the liquid nitrogen is produced. The compressor 18 and the expander 23 can be driven by an electric motor connected by the same drive shaft. Whereas the compressor 18' and the expander 23' can also be connected by another drive shaft and driven by another electric motor turning at a different speed, such that it is able to precisely regulate the temperature of the compressed nitrogen that is taken into the expander 23, this temperature being preferably close to the point of liquefaction.

As will be described later in relation to the procedure for the production of liquid nitrogen, the system is designed such that, when it is put into operation, it produces a succession of cycles within the compressor and within the expander.

The system using the invention clearly comprises means of control to manage the opening and closing of the various apertures (inlets, outlets) of the expander and the compressor in order to synchronise these cycles and their various phases (intake, expansion, compression, release). Such means are known in their own right and are not described in detail.

In one variant and in relation to FIGS. 5 and 9, the intake 183 is not required, the gaseous nitrogen being already pressurised and injected into the pipe 19, for example.

6.2.2. Procedure for the Production of Liquid Nitrogen

Figure 7:
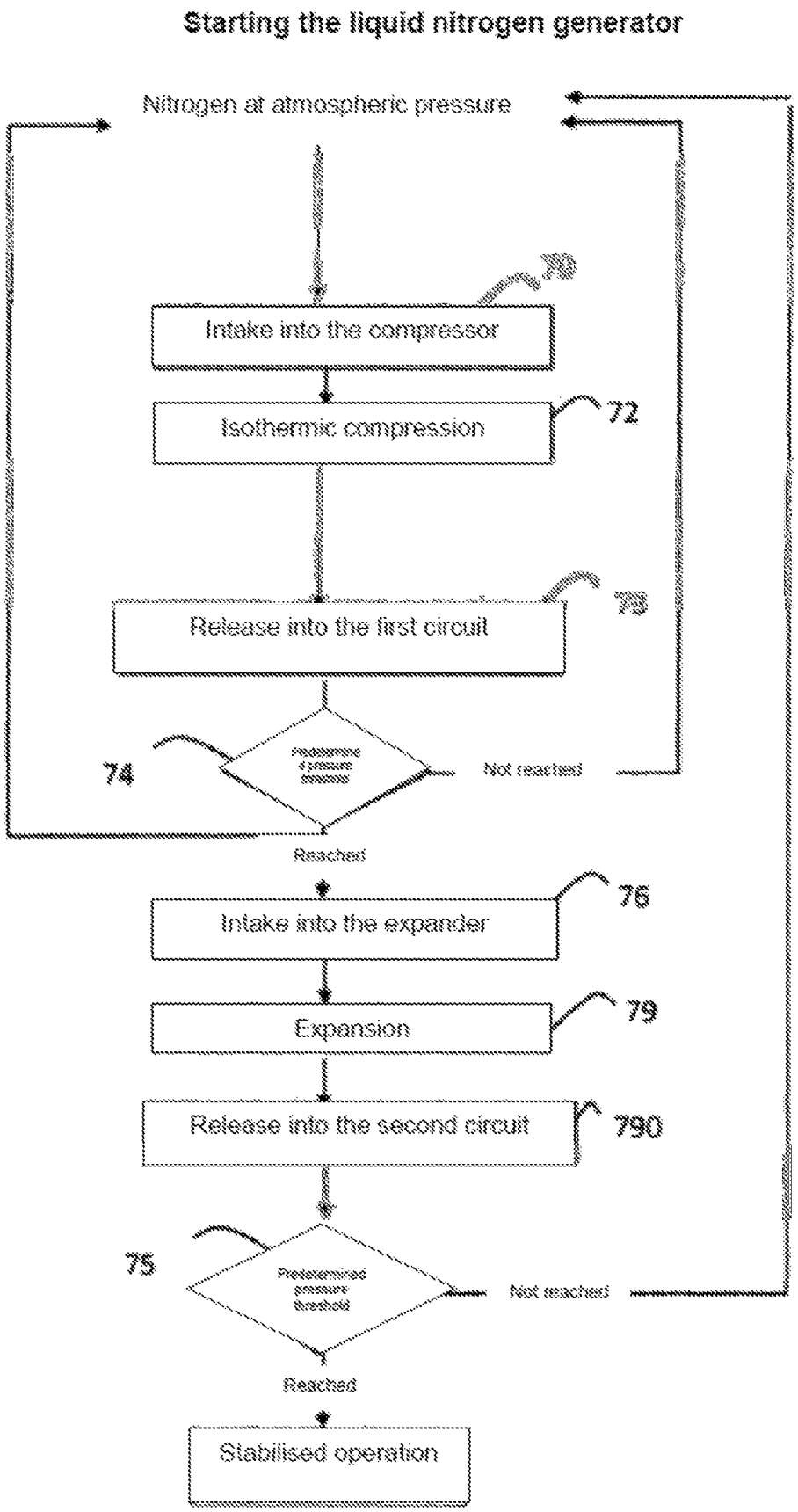
FIG. 7 illustrates a flowchart for the start-up of a liquid nitrogen production procedure using the invention.

A procedure for the production of liquid nitrogen will now be described in relation to FIG. 7.

During operation, the system comprises two circuits, each connected to the compressor and to the expander in such a way that the nitrogen circulates within a closed circuit.

The first circuit, operating at high pressure (for example, between 5 and 100 bar), connects apertures 180 and 231. The second circuit, operating at low pressure (for example, between 1 and 10 bar), connects apertures 230 and 181. The gaseous nitrogen contained within the first circuit, pressurised by the compressor, is expanded within the second circuit by the expander.

The pressures within the two circuits will be regulated so as to maintain them at a predetermined pressure level by adjusting the quantities of fluids entering the expander on the one hand and the nitrogen added to the system by the compressor on the other hand.

When the system is started, a step 70, taking in air or nitrogen via the inlet 183, and a step 72, compression within the compressor 18, are put into operation in such a way as to feed the first circuit (release step 73) via the aperture 180 to pressurise it. To do this, compressor 18 is operated until the pressure within the first circuit reaches a predetermined threshold value (step 74).

Once the first high pressure circuit is pressurised, the second circuit is filled via the expander, whilst maintaining the pressure within the first circuit via the compressor.

To do this, air or gaseous nitrogen continues to enter the compressor (step 70) and is compressed isothermically within the compressor (step 72) whilst putting into operation a step 76, intake of compressed gaseous nitrogen into the expander, in order to expand it (step 79) then to extract it (release step 790) in order to introduce it into the second circuit via aperture 230. These steps are implemented in a loop until the pressure within the first circuit and the pressure within the second circuit reach their respective predetermined threshold value (steps 74 and 75). As soon as these pressures are reached, signifying that the system is stabilised, step 70, intake of external gaseous nitrogen, stops.

This constitutes an example of the start-up phase. Another start-up mode may be implemented.

During this start-up phase, the nitrogen cools as it undergoes adiabatic expansion. Its circulation within the second circuit therefore begins cooling the compressed gaseous nitrogen within the first circuit as a result of the fact that these two circuits pass through the heat exchanger.

The first and second circuits constitute buffer reserves.

The start-up phase is followed by a stabilised operating phase, the implementation of which enables liquid nitrogen to be produced.

During the stabilised operating phase, step 70, the intake of ambient nitrogen, is stopped. Therefore, the system operates as a closed circuit.

During this operating as a closed circuit, the following steps are implemented in a successive loop:

- step 80, the intake of heated non-liquefied nitrogen from the exchanger 16 into the compressor through the pipe 19 and the inlet 181 (the production of this non-liquefied nitrogen will appear more clearly below);
- step 81, the isothermic compression of non-liquefied nitrogen in the compressor;
- step 82, the release of compressed, gaseous, non-liquefied nitrogen from the compressor;
- step 83, the intake, via the inlet 161, of compressed, gaseous, non-liquefied nitrogen released from the compressor through the outlet 180 into the heat exchanger 16;
- step 84, cooling the compressed, gaseous, non-liquefied nitrogen within the heat exchanger (this will be described more clearly below);
- step 85, the intake into the expander 23 of compressed, cooled, gaseous nitrogen from the heat exchanger 16: to do this, the compressed, cooled, gaseous nitrogen is released from the heat exchanger 16 through the outlet 160, before entering the expander 23 through the inlet 231;
- step 86, the adiabatic expansion of compressed, cooled, gaseous nitrogen within the expander: this expansion results in the production of liquid nitrogen as the liquefaction of the nitrogen within the expander is not complete;
- step 87, the release of a mixture of liquid nitrogen and non-liquefied nitrogen through the outlet 230 from the expander 23;
- step 88, the separation of phases enabling the liquefied nitrogen to be separated from the non-liquefied, gaseous nitrogen: the mixture of liquid nitrogen and non-liquefied nitrogen is delivered through the pipe 22 into the valve 21, integrating the means of separating a liquid phase and a gaseous phase;
- step 89, the recovery of liquid nitrogen and possibly a step for the delivery of the liquefied nitrogen into the reservoir 10 through the pipe 26 and the inlet 11';
- step 90, the recovery of non-liquefied nitrogen;
- step 91, the intake of non-liquefied, gaseous nitrogen into the heat exchanger through the inlet 163: the circulation of the non-liquefied, gaseous nitrogen, which is cold, within the exchanger enables the compressed gaseous nitrogen to be cooled in step 84 and, therefore, to heat the non-liquefied, gaseous nitrogen (step 92).

During this closed-circuit operation, the production of liquid nitrogen results in a drop-in pressure within the circuit comprising the first and second circuit. To compensate for this drop-in pressure, the gaseous nitrogen outside the circuit must be introduced into it. With this aim, rather than having the non-liquefied nitrogen enter the compressor from the exchanger (step 80), the ambient gaseous nitrogen enters through the inlet 183 during an intake step 93, similar to that implemented during the system start-up phase.

To determine the moment at which the intake step 93 substitutes the intake step 80 during the stabilised operating phase, step 94, determining at least one piece of representative information regarding the quantity of liquid nitrogen produced, is implemented. This information is compared to an initial predetermined threshold value (step 95). The intake step 93 replaces the intake step 80 as soon as the representative information regarding the quantity of liquid nitrogen produced reaches this initial predetermined threshold value.

One method of determining the moment for switching intake 80 for intake 93 consists of implementing a pressure measurement step within the first circuit or within the second circuit, then a step for comparing the pressure value measured to a predetermined low threshold value, the switch from intake step 71 to step 70 takes place once this threshold value is reached.

Another method of determining the moment for switching intake 80 for intake 93 consists of implementing a step for measuring the quantity of liquid nitrogen produced, by mass or by volume, then a step for comparing the value measured with a predetermined threshold value, the switch from intake step 80 to step 93 takes place once this threshold value is reached.

Once the switch in intake is performed, the system operates to produce liquid nitrogen, but, temporarily, no longer in a closed circuit, the gaseous nitrogen that is reintroduced being compressed isothermically within the compressor 18 (step 98).

One operating cycle in external intake mode is sufficient to restore the pressure of the circuit for several subsequent cycles in internal intake mode.

In the variant wherein intake 183 is not required, the gaseous nitrogen will be already pressurised and injected into the pipe 19. The intake step 93 and the compression step 98 are not required.

Some of the cold nitrogen from the expander is released from the circuit in liquid form. The quantity of hot nitrogen from the compressor that is introduced into the exchanger is thus greater than the quantity of cold, non-liquefied nitrogen from the expander that is introduced into the exchanger. When the operation of the heat exchanger no longer allows the compressed gaseous nitrogen from the compressor to be cooled sufficiently, a direct intake cycle of compressed nitrogen into the expander is initiated. This increases the quantity of cold nitrogen introduced into the exchanger to improve the cooling of the compressed nitrogen.

During stabilised operating, the procedure thus comprises a step 99, the direct intake of more compressed gaseous nitrogen into the expander 23 from the compressor 18. Intake step 99 temporarily replaces step 85, the intake of compressed gaseous nitrogen.

To do this, this compressed gaseous nitrogen is released from the compressor 18, through the outlet 182 and is fed into the expander 23 through the pipe 24 and the inlet 232.

The procedure also comprises a step 100, the expansion of compressed gaseous nitrogen admitted directly into the expander 23. This expansion results in the production of cold, non-liquefied nitrogen which, after being released from the expander (step 101), then enters the exchanger through the pipe 20 and the inlet 163 to improve the efficiency of the exchanger.

The direct intake 99 of gaseous nitrogen from the compressor 18 into the expander 23 through the pipe 24 is implemented using cooling needs within the exchanger 18. A temperature probe T° may, for example, be placed at outlet 160 for compressed cold nitrogen from the exchanger to implement a step 800, measuring the temperature of cooled nitrogen as it leaves the exchanger, then a step 801, comparing this temperature with a predetermined high temperature threshold, to control the implementation of step 99, the direct intake, when this high threshold is reached. The cooling of the compressed nitrogen within the exchanger is thus maximised, which enables the subsequent production of liquid nitrogen within the expander to be increased. The return of the system in terms of production of liquid nitrogen is thus improved.

To stop the implementation of step 99, direct intake, a step 802, comparison of the temperature measured with a predetermined low temperature threshold is implemented. Step 99, direct intake, is stopped when this low threshold is reached. Step 85, the intake of compressed gaseous nitrogen, again replaces step 99, direct intake.

A start-up phase must be implemented prior to step 99, direct intake, in order to pressurise the pipe 24. To do this, inlet 182 is opened instead of inlet 180 into the operating compressor until the pressure within the pipe 24 reaches a predetermined threshold value. When this threshold value is reached, it moves to a stabilised operating phase.

During the stabilised operating phase, the pipe 24 is kept pressurised by the opening of outlet 182 from the compressor, the nitrogen being able to originate from either the inlet 183 (when the external nitrogen has to be reintroduced into the system) or from the inlet 181.

Two different expanders may be operated, one to expand the cooled, compressed nitrogen circulating within the pipe 15, the other to expand the compressed nitrogen circulating within the pipe 24. The two expansions can take place simultaneously. One of these expanders will comprise an inlet 231 and an outlet 230. The other will comprise an inlet 232 and an outlet 230.

Two compressors may be put into operation. One of these compressors will comprise an inlet 181, an outlet 180 and, if necessary, an inlet 183. The other will comprise an inlet 181, an outlet 182 and, if necessary, an inlet 183. The two compressions within these compressors may take place simultaneously.

According to FIG. 9, if two expanders and two compressors are put into operation, there may be two distinct return circuits.

The first circuit is composed of the original circuit with the isothermic compressor 18 and the adiabatic expander 23, the exchanger 16, the two networks of pipes between the apertures 230 and 181 and 231 and 180, the separator 21 with the outlet 26 for liquid nitrogen and the inlet 183 for gaseous nitrogen. The pipe 24 is located in the second circuit.

The second circuit is composed of the second compressor 18' and which thus comprises the outlet 182 connected to the pipe 24, itself connected to the second expander 23' through the inlet 232 whilst another network of pipes 1, 2 and 3 connects the outlet 230' from the expander 23' to the inlet 181' of the second isothermic compressor 18', crossing the exchanger 16 through the inlet 163' and the outlet 162'. The exchanger 16 is thus crossed by two pipes 2 and 16'.

The two circuits composed primarily of two networks each are independent from each other and can therefore operate at different pressures, the second circuit which is completely closed and which can carry a gas other than nitrogen provides the cooling of the exchanger 16 whilst the first circuit generates liquid nitrogen by expanding the nitrogen that is cooled within the exchanger and compressed within the compressor. The cooling circuit offsets the liquid nitrogen produced that does not have a part to play in cooling the compressed nitrogen within the exchanger. The regulation of the cooling circuit is ensured by a temperature probe placed on the pipe 25 which supplies the expander where the liquid nitrogen is produced. The compressor 18 and the expander 23 may be driven by an electric motor, the whole being connected by the same drive shaft. Whilst the compressor 18' and the expander 23' can also be connected by another drive shaft and driven by another electric motor turning at a different speed, such that the temperature of the compressed nitrogen that enters the expander 23 can be precisely regulated, this temperature may be close to the point of liquefaction. This variant consists of creating an external circuit for producing cold that passes through the heat exchanger put into operation during the production of liquid nitrogen to cool the compressed gaseous nitrogen within the expander.

Thus, a multitude of cycles is produced within the system enabling the production of liquid nitrogen which is, for example, stored in the reservoir 10.

6.3. Production of Liquid Nitrogen or Alternatively of Mechanical Energy

As was described above, the invention comprises a mechanical system for the generation of mechanical energy from liquid nitrogen and a mechanical system for the production of liquid nitrogen.

These two systems can be put into operation totally independently of each other.

In one variant, the system may be reversible such that it is able to operate alternatively in a motor mode as a system for generating mechanical energy and in a generator mode as a system for producing liquid nitrogen.

A non-reversible mechanical system for the generation of mechanical energy, for example, does not comprise valve 14, valve 21, pipe 25, pipe 26 and apertures 231 and 11'. It may or may not comprise pipe 19 and aperture 181.

A non-reversible mechanical system for the production of liquid nitrogen, for example, does not comprise valve 14, pipe 12, pump 13 and apertures 11 and 234.

A system for the generation of mechanical energy and the production of liquid nitrogen, which is to say a reversible system having a motor mode and a generator mode, comprises all of the components required to operate in motor mode and in generator mode, valves 14 and 21 allowing some pipes to be made non-operational in each of the operating modes.

A valve may be placed along pipe 19 to allow the intake into the heat exchanger of ambient air and/or compressed gas from the expander when in motor mode and, when in generator mode, circulation between outlet 162 from the exchanger and inlet 181 to the compressor.

6.4. Variant

In motor mode, the system that compresses the gas which was used to vaporise the liquid nitrogen enables a large quantity of compressed gas to be produced within a compact system. In effect, the gas is compressed after having been cooled then it is used to vaporise the liquid nitrogen.

Using one variant, this compressed gas may be injected into an existing expander, such as into the cylinders of the engine of a vehicle during the intake phase, for example. The system using the invention constitutes a compressed gas generator that is able to act as a turbocharger.

Such a system for producing compressed gas may also supply, for example, a compressed air motor or an energy storage system that uses compressed air.

The invention claimed is:

1. A system for selectively generating mechanical energy form liquid nitrogen or air or liquefying nitrogen or air, the system comprising—

A plurality of valves, operative to switch the system between two operational modes—a first operational mode for generating mechanical energy, and a second operational mode for liquefying nitrogen a first piston device, configured to operate as a compressor in the first operational mode and as an expander in the second operational mode, a second piston device, separate from said first piston device, configured to operate as an expander in the first operational mode and as a compressor in the second operational mode, and a heat exchanger;

wherein the heat exchanger includes— a first aperture, configured in the first operational mode as an inlet for liquid nitrogen and in the second operational mode as an outlet for air or compressed cooled gaseous nitrogen, a second aperture, configured in the first operational mode as an inlet for air or gaseous nitrogen and in the second operational mode as an outlet for heated non-liquefied nitrogen, a third aperture, fluidly connected through a pipe within the heat exchanger to the first aperture and configured in the first operational mode as an outlet for vaporised nitrogen and in the second operational mode as an inlet of compressed gaseous nitrogen and a fourth aperture, configured in the first operational mode as an outlet for air or cooled gaseous nitrogen and in the second operational mode as an inlet for non-liquefied nitrogen;

wherein the first piston device includes— a first aperture, fluidly connected to the fourth aperture of the heat exchanger and configured in the first operational mode as an inlet for the air or cooled gaseous nitrogen and in the second operational mode as an outlet for said non-liquefied nitrogen, and a second aperture, fluidly connected, in the second operational mode, through one of said valves to the first aperture of the beat exchanger and configured as an inlet of the air or compressed cooled gaseous nitrogen;

wherein the second piston device includes— a first aperture, fluidly connected to the third aperture of the heat exchanger and configured in the first operational mode as an inlet for said vaporised nitrogen and in the second operational mode as an outlet for said compressed nitrogen, and a drive shaft for recovering energy originating from the expansion of any gas within the second piston device;

and wherein the system further comprises a bypass conduit, fluidly connecting directly between the second piston device and the first piston device, bypassing the heat exchanger, and switchably operative in the first operating mode to send the cold air compressed by the first piston device directly into the second piston device, to expand therein, and switchably operative in the second operating mode to send the air or nitrogen compressed by the second piston device directly into the first piston device to expand therein.

2. The system of claim 1, wherein the second piston device further includes a second aperture, fluidly connected to the second aperture of the heat exchanger and configured in the first operational mode to let gaseous nitrogen, still under pressure, flow from the second piston device to the heat exchanger.

3. The system of claim 1, further comprising means for determining the temperature of gas flowing through the first aperture of the heat exchanger, and being configured, when in the second operational mode, so that air or nitrogen compressed by the second piston device passes directly through the bypass conduit, rather than through the heat exchanger, said temperature is above a predetermined high threshold and vice versa when said temperature is below a predetermined low threshold.

4. The system of claim 1 further comprising a reservoir and configured so that nitrogen produced in the second operational mode is stored in the reservoir and said stored nitrogen is used in the first operational mode to generate mechanical energy.

5. The system of claim 1, wherein also the first piston device includes a drive shaft, connected to said drive shaft in the second piston device and configured to be driven thereby.

6. The system of claim 1, wherein the first piston device and/or the second piston device include, each, an aperture for releasing air or nitrogen therewithin into the atmosphere or for introducing air or nitrogen from the atmosphere.

7. The system of claim 1, further comprising means for heating or cooling nitrogen and/or air within, or prior to entering, any of said piston devices.

8. The system of claim 1, further comprising a valve, interjected in the connection between the first aperture of the first piston device and the fourth aperture of the heat exchanger and operative, in the second operational mode, to separate liquid nitrogen from non-liquefied nitrogen.

9. A procedure for generating mechanical energy from liquid nitrogen, comprising at least:

vaporizing liquid nitrogen under pressure within a heat exchanger, whereby air or gaseous nitrogen at approximately ambient temperature cools during its passage across the heat exchanger;

passing the vaporized nitrogen from the heat exchanger into an expander;

letting the vaporized nitrogen within the expander expand so as to generate mechanical energy;

passing expanded gaseous nitrogen from the expander into the heat exchanger;

passing the cooled air or gaseous nitrogen from the heat exchanger into a compressor;

compressing the cooled air or gaseous nitrogen within the compressor;

passing the compressed air or gaseous nitrogen from the compressor into the expander and heating it during said passing or within the expander, thereby causing it to expand;

recovering mechanical energy resulting from said expansions.

10. A procedure for liquefying nitrogen comprising:

cooling compressed air or gaseous nitrogen in a heat exchanger;

expanding said cooled air or gaseous nitrogen within an expander, resulting in the production of a mixture of liquid nitrogen and non-liquefied nitrogen;

separating the liquid nitrogen from the non-liquefied nitrogen in said mixture;

passing the non-liquefied nitrogen into the heat exchanger so as to effect said cooling of compressed air or gaseous nitrogen;

compressing the cooled non-liquefied nitrogen from the heat exchanger within a compressor;

heating the compressed cooled non-liquefied nitrogen from the compressor in the heat exchanger;

determining the temperature of the compressed and cooled gaseous nitrogen at an outlet of the heat exchanger passing non-liquefied compressed nitrogen from the compressor into the expander, wherein said passing is direct when said temperature is above a predetermined high threshold and said passing is through the heat exchanger when said temperature is below a predetermined low threshold;

letting the air or gaseous nitrogen within the expander expand, resulting in the production of a mixture of liquid nitrogen and non-liquefied nitrogen, passing the expanded non-liquefied nitrogen from said expander into the heat exchanger so as to heat it;

compressing air or nitrogen to produce said compressed air or gaseous nitrogen.

11. The procedure of claim 10, wherein said expanding of cooled air or gaseous nitrogen from the heat exchanger and said expanding the non-liquefied compressed nitrogen from the compressor are performed simultaneously within corresponding separate expanders.

* * * * *